US010624453B2

(12) United States Patent
Jeon et al.

(10) Patent No.: US 10,624,453 B2
(45) Date of Patent: Apr. 21, 2020

(54) BATHROOM MANAGEMENT APPARATUS

(71) Applicant: LG ELECTRONICS INC., Seoul (KR)

(72) Inventors: Jinhyeon Jeon, Seoul (KR); Inhyung Yang, Seoul (KR); Daeyun Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/792,042

(22) Filed: Oct. 24, 2017

(65) Prior Publication Data

US 2018/0110382 A1 Apr. 26, 2018

(30) Foreign Application Priority Data

Oct. 24, 2016 (KR) ..... 10-2016-0138290

(51) Int. Cl.
*A47B 67/02* (2006.01)
*E05D 15/10* (2006.01)
*E05D 15/06* (2006.01)

(52) U.S. Cl.
CPC ..... *A47B 67/02* (2013.01); *E05D 15/0608* (2013.01); *E05D 15/0621* (2013.01);
(Continued)

(58) Field of Classification Search
CPC . A47B 47/0091; A47B 95/008; A47B 67/005; A47B 67/02; A47B 81/00; A47B 67/00; A47K 10/06; A47K 17/00; E05Y 2900/20; E05Y 2201/212; E05Y 2201/412; E05Y 2201/684; E05Y 2600/314; F25D 11/00; F24H 3/022; E05D 15/0621; E05D 15/0604; E05D 15/0608; E05D 15/10;
(Continued)

(56) References Cited

U.S. PATENT DOCUMENTS 1,918,047 A * 7/1933 Marchand ..... A47B 67/005 362/129
3,829,187 A * 8/1974 Stewart ..... A47B 3/00 312/140.1

(Continued)

FOREIGN PATENT DOCUMENTS

| | | |
|---|---|---|
| CN | 202235005 | 5/2012 |
| CN | 204541338 | 8/2015 |
| CN | 105231920 | 1/2016 |

OTHER PUBLICATIONS

Chinese Office Action dated Apr. 19, 2019 issued in Application No. 201711003550.9 (English translation attached).

*Primary Examiner* — Hiwot E Tefera
(74) *Attorney, Agent, or Firm* — KED & Associates, LLP

(57) ABSTRACT

A bathroom management apparatus is provided which can minimize the likelihood of door-sliding components being seen from the outside. The bathroom management apparatus may include a cabinet forming an interior space whose front is open; a first dividing plate provided within the cabinet and dividing the interior space; a second dividing plate provided within the cabinet in parallel with the first dividing plate and dividing the interior space, and forming a storage chamber in the space between the first and second dividing plates; and a door slidably installed on the first dividing plate and second dividing plate and opening and closing the storage chamber.

13 Claims, 25 Drawing Sheets

(52) U.S. Cl.
CPC ..... *E05D 15/0652* (2013.01); *E05D 15/10* (2013.01); *E05Y 2900/20* (2013.01)

(58) Field of Classification Search
CPC ..... E05D 15/1042; E05D 15/0634; E05D 15/0639; E05D 15/0652; E05D 15/0656; E05D 2015/1005; E05F 1/16; E05F 3/06; E05F 3/18; E05F 5/003; F24F 1/022; F24F 3/153; F24F 13/0272; F24F 13/0604; E03D 9/04
USPC .... 312/224–227, 245, 242, 351, 209, 138.1, 312/322; 49/209, 213, 216, 218, 219, 49/220
See application file for complete search history.

(56) References Cited

U.S. PATENT DOCUMENTS 3,909,091 A * 9/1975 Tantillo ..... A47B 95/008 312/224
4,610,489 A * 9/1986 Dibert, Jr. ..... A47B 67/005 16/262
4,704,819 A * 11/1987 Tutikawa ..... E05D 15/1042 16/102
4,708,410 A * 11/1987 Mazaki ..... E05D 15/1065 312/138.1
4,753,496 A * 6/1988 Bussard ..... F24F 7/065 312/116
4,966,424 A * 10/1990 Schneider ..... A47B 67/02 312/263
5,271,181 A * 12/1993 Pietro ..... B60J 5/062 49/118
6,932,488 B1 * 8/2005 Horn ..... A47G 1/02 362/128
8,166,667 B1 * 5/2012 Lora ..... F26B 9/003 34/202
8,763,205 B2 * 7/2014 Schmidhauser ..... E05D 15/10 16/92
8,869,493 B2 * 10/2014 Chubb ..... E06B 7/16 312/138.1
9,389,011 B2 * 7/2016 Kim ..... E05D 7/00
9,752,367 B2 * 9/2017 Girotto ..... E05D 15/0652
10,016,056 B2 * 7/2018 Sklansky ..... A47B 97/00
2004/0098831 A1 * 5/2004 Elmer ..... E05D 15/063 16/89
2004/0107646 A1 * 6/2004 Elmer ..... E05D 15/0652 49/410
2007/0033874 A1 * 2/2007 Jacobs ..... E05D 15/0626 49/130
2010/0199563 A1 * 8/2010 Bortoluzzi ..... E05D 15/08 49/128
2011/0050058 A1 * 3/2011 Smith ..... A47B 46/00 312/227
2013/0239484 A1 9/2013 Chubb et al.
2014/0082886 A1 * 3/2014 Bortoluzzi ..... E05D 15/1042 16/97
2014/0145578 A1 * 5/2014 Trecco ..... F16C 29/001 312/334.1
2015/0068124 A1 * 3/2015 Fornasari ..... E05D 15/1042 49/130
2015/0300068 A1 * 10/2015 Yoon ..... E06B 3/4672 16/65
2016/0000236 A1 * 1/2016 Goppion ..... E05D 15/46 312/138.1
2016/0312521 A1 * 10/2016 Berger ..... E06B 3/4672
2016/0345728 A1 * 12/2016 Lehndorf ..... A47B 67/02
2017/0306676 A1 * 10/2017 Girotto ..... E05D 15/1065

* cited by examiner

BATHROOM MANAGEMENT APPARATUS

CROSS-REFERENCE TO RELATED APPLICATION

This application claims priority under 35 U.S.C. § 119 to Korean Application No. 10-2016-0138290 filed on Oct. 24, 2016, whose entire disclosure is hereby incorporated by reference.

BACKGROUND

1. Field

The present disclosure relates to a bathroom management apparatus, and more particularly, to a bathroom management apparatus integrated with a storage cabinet and an air conditioning module.

2. Background

Bathrooms are rooms in homes for personal hygiene activities and may include, for example, a sink (or basin), a bathtub and/or a shower, and the toilet. A bathroom is generally the most humid place in the home and, therefore, is susceptible to a growth of mold, germs, and bacteria and resulting odors.

Certain bathrooms may be dried and deodorized using an exhaust fan. However, the exhaust fan may not work properly or may be insufficient, by itself, to keep the entire bathroom dry. Any remaining moisture may permit mold and bacteria to thrive, causing undesirable contamination in the bathroom. Thus, it is desirable to remove moisture from the bathroom floor and walls and to dry wet bathroom items, such as towels hanging on towel bars or rings in the bathroom, as quickly as possible in order to prevent mold and bacteria growth.

Bathrooms may have a storage cabinet (or medicine cabinet) which is installed on a bathroom wall to store various items such as towels. The storage cabinet may have an air conditioning module that outputs a flow of air into the bathroom to dry the bathroom. Since bathrooms may be smaller in space in comparison to other rooms in a home, it is often desirable in terms of bathroom space utilization that the storage cabinet includes a sliding-type door. However, rails for sliding the door may be exposed when the door opens or closes, and the exposed rails do not look good in terms of aesthetics. Furthermore, as previously described, bathrooms tend to have relatively high levels of humidity due to the frequent presence of water, and moisture may get into the storage cabinet unless the door seals the storage cabinet.

BRIEF DESCRIPTION OF THE DRAWINGS

The embodiments will be described in detail with reference to the following drawings in which like reference numerals refer to like elements wherein.

DETAILED DESCRIPTION

Figure 1:
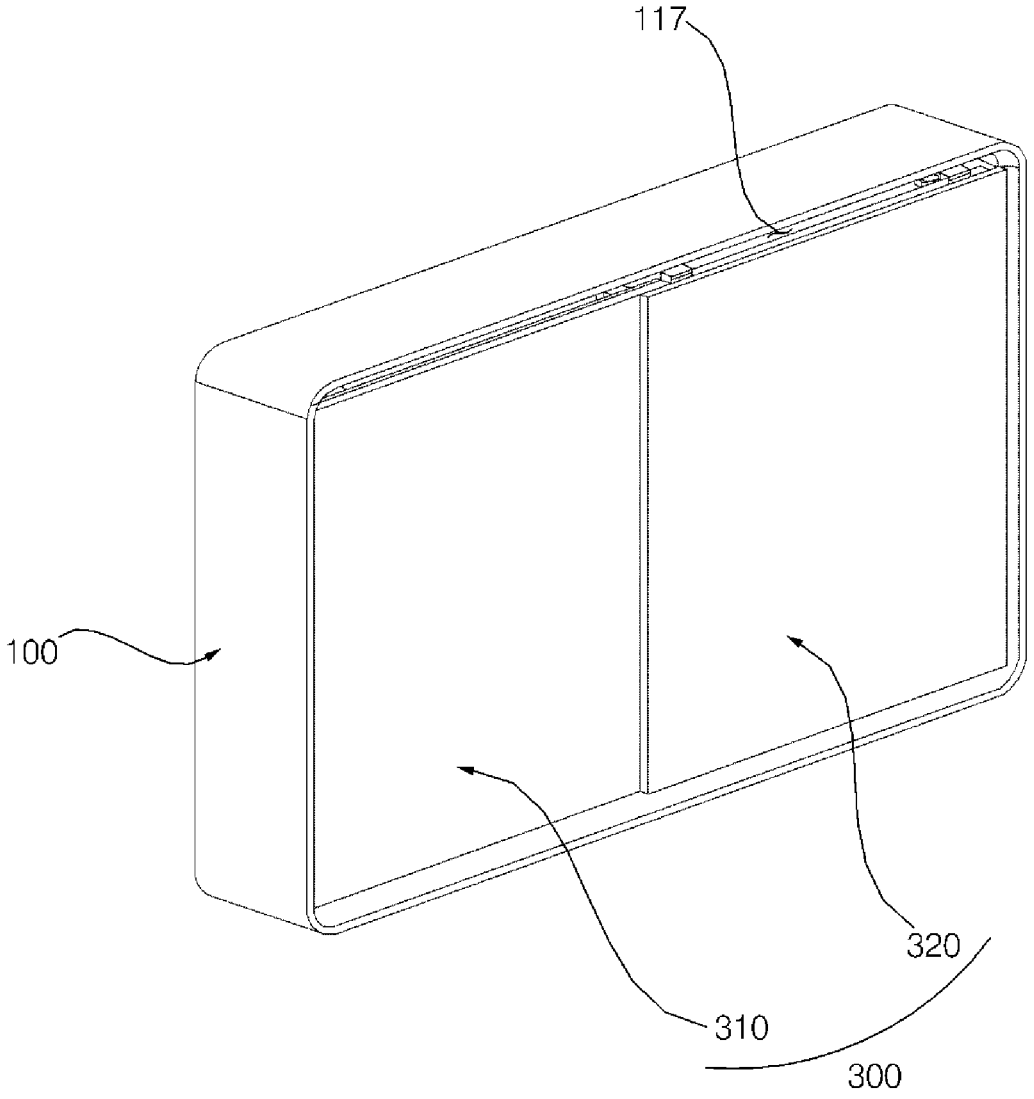
FIG. 1 is an assembled perspective view of a bathroom management apparatus according to a first exemplary embodiment of the present disclosure.

Hereinafter, a bathroom management apparatus according to embodiments of the present disclosure will be described with reference to the accompanying drawings.

Referring to FIGS. 1 to 4, the bathroom management apparatus according to the first exemplary embodiment of the present disclosure may include a cabinet 100, an air conditioning module (or dryer) 200, and a door 300. The cabinet 100 may form an interior space whose front may be opened for access by a user. The cabinet 100 may be in the shape of a rectangle with a top portion (or surface), a bottom portion (or surface), and left and right portions (or surfaces), whereby these directions as described relative to a user positioned in front of the bathroom management apparatus installed on a wall of a bathroom. Likewise, the interior space of the cabinet 100 may be in the shape of a rectangle.

The cabinet 100 may include a front cabinet 110 and a rear cabinet 120. The front cabinet 110 may be in the shape of a rectangle whose front and rear may be open. The front cabinet 110 may include a top portion 111 forming the top side, a left portion 112 forming the left side, a right portion 113 forming the right side, and a bottom portion 114 forming the bottom side. The top portion 111, left portion 112, right portion 113, and bottom portion 114 may be substantially planar to be and may be made flat and straight. In the front cabinet 110, each of the corner between the top portion 111 and the left portion 112, the corner between the top portion 111 and the right portion 113, the corner between the bottom portion 114 and the left portion 112, and the corner between the bottom portion 114 and the right portion 113 may be curved.

The rear cabinet 120 may include a rectangular rear portion 121, a top portion 122 protruding forward from the top of the rear portion 121, a left portion 123 protruding forward from the left of the rear portion 121, and a right portion 124 protruding forward from the right of the rear portion 121. The rear portion 121, top portion 122, left portion 123, and right portion 124 may be substantially planar to be and may be made flat and straight. In the rear cabinet 120, each of the corner between the top portion 122 and the left portion 123, the corner between the top portion 122 and the right portion 124, and the bottom facing the top portion 122 may be open.

The front cabinet 110 may be inserted into the rear cabinet 120 from the front of the rear cabinet 120 and may be attached to the rear cabinet 120. That is, the top portion 122 of the rear cabinet 120 may be attached onto the top portion 111 of the front cabinet 110, the left portion 123 of the rear cabinet 120 may be attached to the left of the left portion 112 of the front cabinet 110, and the right portion 124 of the rear cabinet 120 may be attached to the right of the right portion 113 of the front cabinet 110. In this manner, when the front cabinet 110 and the rear cabinet 120 are attached, the corner between the top portion 111 and left portion 112 of the front cabinet 110 may block off the open corner between the top portion 122 and left portion 123 of the rear cabinet 120, and the corner between the top portion 111 and right portion 113 of the front cabinet 110 may block off the open corner between the top portion 122 and right portion 124 of the rear cabinet 120. Also, the open bottom of the rear cabinet 120 may be blocked off by the bottom portion 114 of the front cabinet 110, the corner between the bottom portion 114 and left portion 112 of the front cabinet 110, and the corner between the bottom portion 114 and right portion 113 of the front cabinet 110.

In this way, the top portion 111 of the front cabinet 110 and the top portion 122 of the rear cabinet 120 may form the top portion of the cabinet 100, and the left portion 112 of the front cabinet 110 and the left portion 123 of the rear cabinet 120 may form the left portion of the cabinet 100. Similarly, the right portion 113 of the front cabinet 110 and the right portion 124 of the rear cabinet 120 may form the right portion of the cabinet 100, and the bottom portion 114 of the front cabinet 110 may form the bottom portion of the cabinet 100. Furthermore, the corner between the top portion 111 and left portion 112 of the front cabinet 110 may form the corner between the top portion and left portion of the cabinet 100, the corner between the top portion 111 and right portion 113 of the front cabinet 110 may form the corner between the top portion and right portion of the cabinet 100, the corner between the bottom portion 114 and left portion 112 of the front cabinet 110 may form the corner between the bottom portion and left portion of the cabinet 100, and the corner between the bottom portion 114 and right portion 113 of the front cabinet 110 may form the corner between the bottom portion and right portion of the cabinet 100. The rear portion 121 of the rear cabinet 120 may form the rear portion of the cabinet 100.

A first dividing plate 410, a second dividing plate 420, and a duct 430 may be provided in the interior space in the cabinet 100. The first dividing plate 410 may be provided between the top portion of the cabinet 100 and the second dividing plate 420 and may be connected to the left portion and right portion of the cabinet 100 to divide the interior space of the cabinet 100 into upper and lower sections. The first dividing plate 410 may be placed at a distance down from the top portion of the cabinet 100, immediately below the top portion of the cabinet 100, and runs laterally. The left edge of the first dividing plate 410 may be attached to the left portion of the cabinet 100, and the right edge may be attached to the right portion of the cabinet 100.

The second dividing plate 420 may be provided between the bottom portion of the cabinet 100 and the first dividing plate 410 and may be connected to the left portion and right portion of the cabinet 100 to divide the interior space of the cabinet 100 into upper and lower sections. The second dividing plate 420 may be provided in parallel with the first dividing plate 410. The second dividing plate 420 may be placed at a distance up from the bottom portion of the cabinet 100, such as immediately above the bottom portion of the cabinet 100, and may run laterally. The left edge of the second dividing plate 420 may be attached to the left portion of the cabinet 100, and the right edge may be attached to the right portion of the cabinet 100.

The first dividing plate 410 and the second dividing plate 420 may be vertically spaced apart from each other and may be provided in the interior space of the cabinet 100. Storage chambers S1 and S2 may be formed in the space between the first dividing plate 410 and the second dividing plate 420. The user may store towels or other bathroom items in the storage chambers S1 and S2.

The duct 430 may be connected to the first dividing plate 410 and the second dividing plate 420 and may separate the storage chambers S1 and S2, respectively, into left and right sections. The duct 430 may be in a T shape, so a top portion has a larger horizontal length than other portions of the duct 430. The duct 430 may be provided in the middle between the left and right sections of the interior space of the cabinet 100, and may divide the storage chambers S1 and S2 equally and symmetrically into left and right sections. The door 300 may slide in a lateral direction to open and/or close the storage chambers S1 and S2.

The door 300 may include a first door 310 and a second door 320. When either the first door 310 or the second door 320 is fully open (e.g., slid to expose storage chambers S1 or S2), the first door 310 and the second door 320 block the duct 430 from the front. That is, a part of the interior space of the cabinet 100 where the duct 430 is installed may be a "dead" zone which be accessed when doors 310 and/or 320 are open and cannot be used as the storage chambers S1 and S2 when the door 300 is open. Since the duct 430 may be installed in the dead zone, the amount of space that can be used as the storage chambers S1 and S2 in the interior space of the cabinet 100 may be maximized.

The front and left and right sides of the duct 430 may be blocked and the rear may be open. The open rear of the duct 430 may be covered by the rear portion of the cabinet 100. Thus, an empty space may be provided between the duct 430 and the rear portion of the cabinet 100, and air may flow in this empty space. Hereinafter, the inside of the duct 430 may be refer to the empty space which exists between the duct 430 and the rear portion of the cabinet 100.

The air conditioning module (also referred to as a dryer module or dryer) 200 may be installed within the duct 430. The air conditioning module 200 may include a case 210 forming the external appearance of the air conditioning module 200, a blast fan 220 installed within the case 210, and a heater 230 installed within the case 210. A fan motor 240 for driving the blast fan 220 may be installed in the case 210. The blast fan 220 may be provided to run laterally and to be installed within the duct 430, and the fan motor 240 may be attached to the case 210. A rotating shaft of the fan motor 240 may be attached to one longitudinal end of the blast fan 220 and may rotate the blast fan 220. The heater 230 may be implemented as an electric heater that converts electric energy into heat energy when supplied with electricity, thereby heating and drying the air in the duct 430.

An air inlet 115 for letting air into the duct 430 may be formed in the bottom portion of the cabinet 100, and the space between the top portion of the cabinet 100 and the first dividing plate 410 may form an air outlet 117 for releasing air out of the duct 430. When the door 300 is closed, the air outlet 117 may release air from the duct 430 toward the front through a gap between the top portion of the cabinet 100 and the top of the door 300.

When the blast fan 220 is driven, the air in the bathroom may be introduced into the duct 430 through the air inlet 115 by the suction force of the blast fan 220, and then the air (after being heated, dried, etc., may be released to the front through the air outlet 117 and discharged into the bathroom. The inside of the bathroom may be dried by the air discharged through the air outlet 117, and the user's body may be dried too if the user directs the air discharged through the air outlet 117 towards themselves (e.g., after a shower).

The blast fan 220 may be installed below the heater 230, and the heater 230 may be installed above the blast fan 220. When the blast fan 220 and the heater 230 are driven, the air introduced into the duct 430 by the suction force of the blast fan 220 may be warmed by the heater 230 and the warmed air may be then discharged into the bathroom through the air outlet 117. If the heater 230 is installed below the blast fan 220, the air introduced into the duct 430 through the air inlet 115 may be warmed by the heater 230 and then passed through the blast fan 220. In this configuration, the blast fan 220 may be heated and deformed by the warm air and/or radiant heat raising from the heater 230. However, in the previously described exemplary embodiment in which the heater 230 is installed above the blast fan 220 and close to the air outlet 117, the blast fan 220 may be not be heated and deformed by the warm air.

A first communicating hole 411 may be formed in the first dividing plate 410 to communicate within the air outlet 117 and the duct 430, and a second communicating hole 421 may be formed in the second dividing plate 420 to communicate within the air inlet 115 and the duct 430.

Moreover, a shield plate 440 may be connected to the bottom portion of the cabinet 100 and the second dividing plate 420. The shield plate 440 may be provided further forward than the air inlet 115 and the second communicating hole 421. The top end of the shield plate 440 may be attached to the second dividing plate 420, and the bottom end may be attached to the lower portion of the cabinet 100. In the space between the air inlet 115 and the second communicating hole 421, the front portion may be blocked by the shield plate 440, the rear portion may be blocked by the rear portion of the cabinet 100, the left portion may be blocked by the left portion of the cabinet 100, and the right portion may be blocked by the right portion of the cabinet 100. Thus, when the blast fan 220 is driven, the air in the bathroom may be introduced into the space between the air inlet 115 and the second communicating hole 421 through the air inlet 115 and then into the duct 430 through the second communicating hole 421, and the air introduced into the duct 430 may pass through the blast fan 220 and the heater 230 and may be then released to the air outlet 117 through the first communicating hole 411.

A filter 116 may be installed in the bottom portion of the cabinet 100. The filter 116 may be installed in the air inlet 115 to remove odors, dust, and bacteria from the air introduced into the air inlet 115 from the bathroom. The filter 116 may be implemented as an antimicrobial filter including a photocatalytic coating layer that is activated by light generated by a second lighting device 520, to be described later.

The first storage chamber S1 may be provided on the left side of the duct 430, and the second storage chamber S2 may be provided on the right side of the duct 430. At least one of the first and second storage chambers S1 and S2 may be divided into multiple sections by storage chamber plates 610 and 620. In this exemplary embodiment, the first storage chamber S1 and the second storage chamber S2 each may be divided into multiple sections by the storage chamber plates 610 and/or 620. The storage chamber plates 610 and 620 may include a horizontal dividing plate 610 dividing the storage chambers S1 and S2 into upper and lower sections and a vertical dividing plate 620 dividing the storage chambers S1 an S2 into left and right sections. The first storage chamber S1 and the second storage chamber S2 may be divided into sections of various sizes by the horizontal dividing plate 610 and the vertical dividing plate 620.

A sterilization module 710 and a refrigeration module 720 may be installed in the storage chambers S1 and S2. The sterilization module 710 and the refrigeration module 720 may be selectively included based on a user option when buying the bathroom management apparatus according to the exemplary embodiment of the present disclosure, and none of which may be installed in the storage chambers S1 and S2, or only one of the sterilization module 710 or the refrigeration module 720 may be installed. Moreover, the number of sterilization modules 710 or refrigeration modules 720 to be installed in the storage chambers S1 and/or S2 may vary (e.g., the storage chambers S1 and S2 may include multiple sterilization modules 710 or refrigeration modules 720). In one exemplary embodiment, one sterilization module 710 may be installed in the first storage chamber S1 and used for sterilizing toothbrushes or other personal items, and two refrigeration modules 720 may be installed in the first storage chamber S1, one for refrigerating cosmetics and the other for storing and cooling other bathroom items.

The sterilization module 710 and the refrigeration module 720 may each include a main body 711 forming a storage space whose front may be open, and a door 712 attached to the front of the main body 711 for opening or closing the storage space. An ionizer 713 that emits ions and sterilizes the inside of the storage space may be installed within the sterilization module 710. Moreover, a lighting device 714 that generates light when the door 712 is open may be installed within the sterilization module 710 and the refrigeration module 720. The lighting device 714 may include a light source that generates light and a case containing the light source, and the light source may be implemented as a light-emitting diode LED.

A heat transfer module 810 that feeds cold air into the refrigeration module 720 and hot air to the outside of the refrigeration module 720 may be installed within the duct 430. Since the heat transfer module 810 may be installed within the duct 430, the hot air fed to the outside of the refrigeration module 720 may be introduced into the duct 430. Thus, when the blast fan 220 is driven, the hot air from the heat transfer module 810 may be discharged into the bathroom through the air outlet 117. Hereinafter, the sterilization module 710 and the refrigeration module 720 will be referred to as a module 700.

Moreover, a power supply 820 for converting electric power may be installed within the duct 430. The power supply 820 may convert commercial power into power for running the blast fan 220, the heater 230, the module 700, and lighting equipment 510, 520, 530, and 540, and supply the power to the fan motor 240, heater 230, module 700, and lighting equipment 510, 520, 530, and 540. The power supply 820 may emit light during the process of converting electric power. Since the power supply 820 may be installed within the duct 430, when the blast fan 220 is driven, the heat emitted from the power supply 820 may be discharged into the bathroom through the air outlet 117.

The heat transfer module 810 and the power supply 820 may be installed lower than the air conditioning module 200 and within the duct 430, and the power supply 820 may be provided between the air conditioning module 200 and the heat transfer module 810. That is, the air conditioning module 200 may be located in the upper part of the duct 430, the power supply 820 may be located lower than the air conditioning module 200, and the heat transfer module 810 may be located lower than the power supply 820.

The door 300 may be slidably installed on the first dividing plate 410 and the second dividing plate 420 and may open or close the first storage chamber S1 and the second storage chamber S2. The door 300 may slide in a lateral direction to open and close the first storage chamber S1 and the second storage chamber S2. As the door 300 may be slidably installed on the first dividing plate 410 and the second dividing plate 420, guide rails 910 and guide units (or guide inserts) 920, which may be components for sliding the door 300, may be blocked by the top portion and bottom portion of the cabinet 100, thereby minimizing the likelihood of the guide rails 910 and the guide units 920 being seen from the outside when the user opens or closes the door 300.

The door 300 may include a first door 310 for opening and closing the first storage chamber S1 and a second door 320 for opening and closing the second storage chamber S2. The first door 310 and the second door 320 may be installed in such a way as to partially overlap in the front-back direction. A mirror 311 may be provided on the front of the door 300. The mirror 311 may be used in place of a bathroom mirror installed on the wall surface of the bathroom.

The door 300 may be inserted into the open interior space of the cabinet 100 from the front of the cabinet 100 and may partially block the open interior space of the cabinet 100 when closed. The door 300 may be placed within the edge of the open front of the cabinet 100, and may be spaced a distance apart from the edge. That is, the door 300 may be inserted into the open interior space of the cabinet 100, with the top being placed a distance below the top portion of the cabinet 100, the bottom being placed a distance above the bottom portion of the cabinet 100, the left being placed a distance to the right from the left portion of the cabinet 100, and the right being placed a distance to the left from the right portion of the cabinet 100. Thus, gaps may be formed between the top portion of the cabinet 100 and the top of the door 300, a between the bottom portion of the cabinet 100 and the bottom of the door 300, between the left portion of the cabinet 100 and the left of the door 300, and between the right portion of the cabinet 100 and the right of the door 300. Preferably, the top of the door 300 may be placed a distance below the top portion of the cabinet 100, with the air inlet 115 being open, so that the air discharged from the duct 430 may be released to the front through the space between the top portion of the cabinet 100 and the top of the door 300.

The first door 310 and the second door 320 may slide in a lateral direction within the edge of the open front of the cabinet 100 to open and close one or more of the storage chambers S1 and S2. In one example, first door 310 and the second door 320 may slide in opposite lateral directions.

Figure 2:
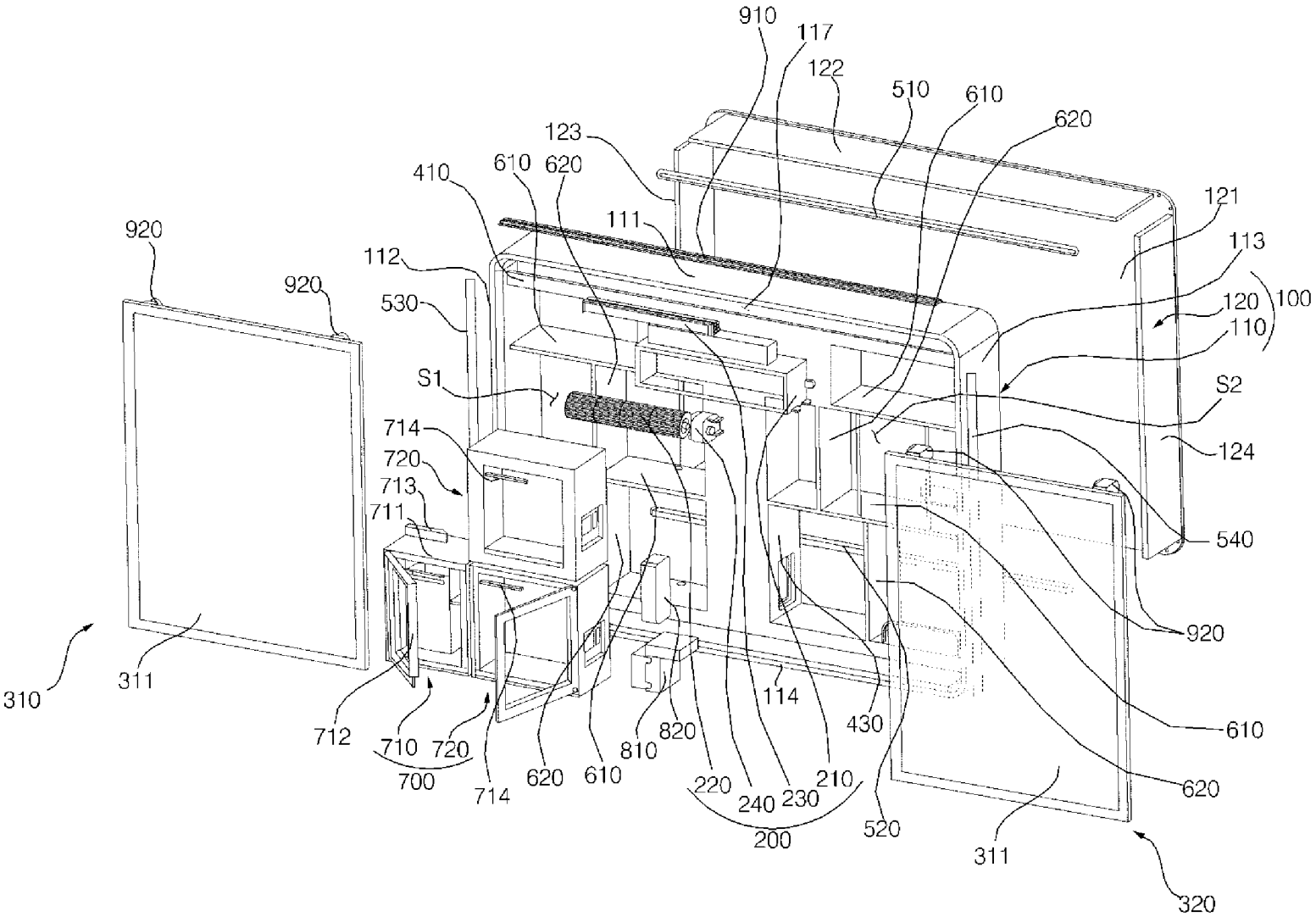
FIG. 2 is an exploded perspective view of the bathroom management apparatus according to the first exemplary embodiment of the present disclosure.
Figure 3:
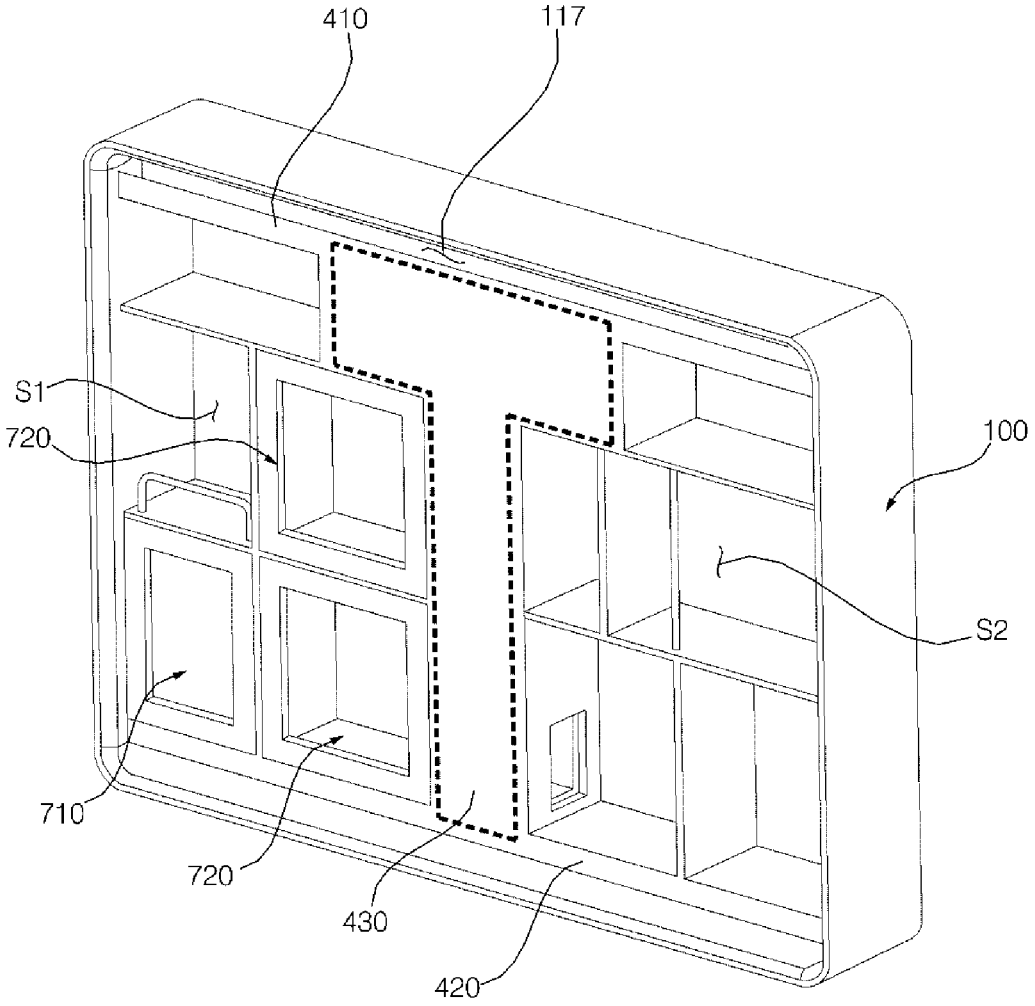
FIG. 3 is a view of a sterilization module and a refrigeration module installed in a cabinet for the bathroom management apparatus according to the first exemplary embodiment of the present disclosure.
Figure 4:
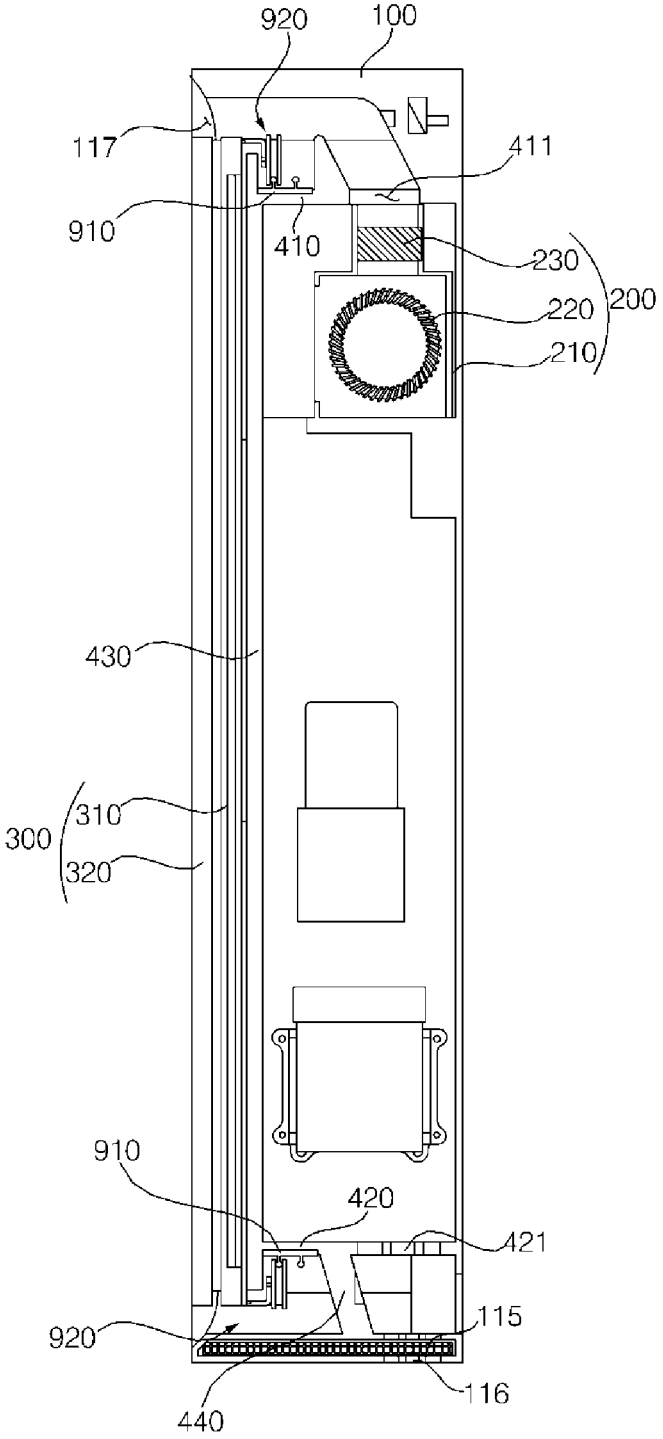
FIG. 4 is a sectional side view of the bathroom management apparatus according to the first exemplary embodiment of the present disclosure.
Figure 5:
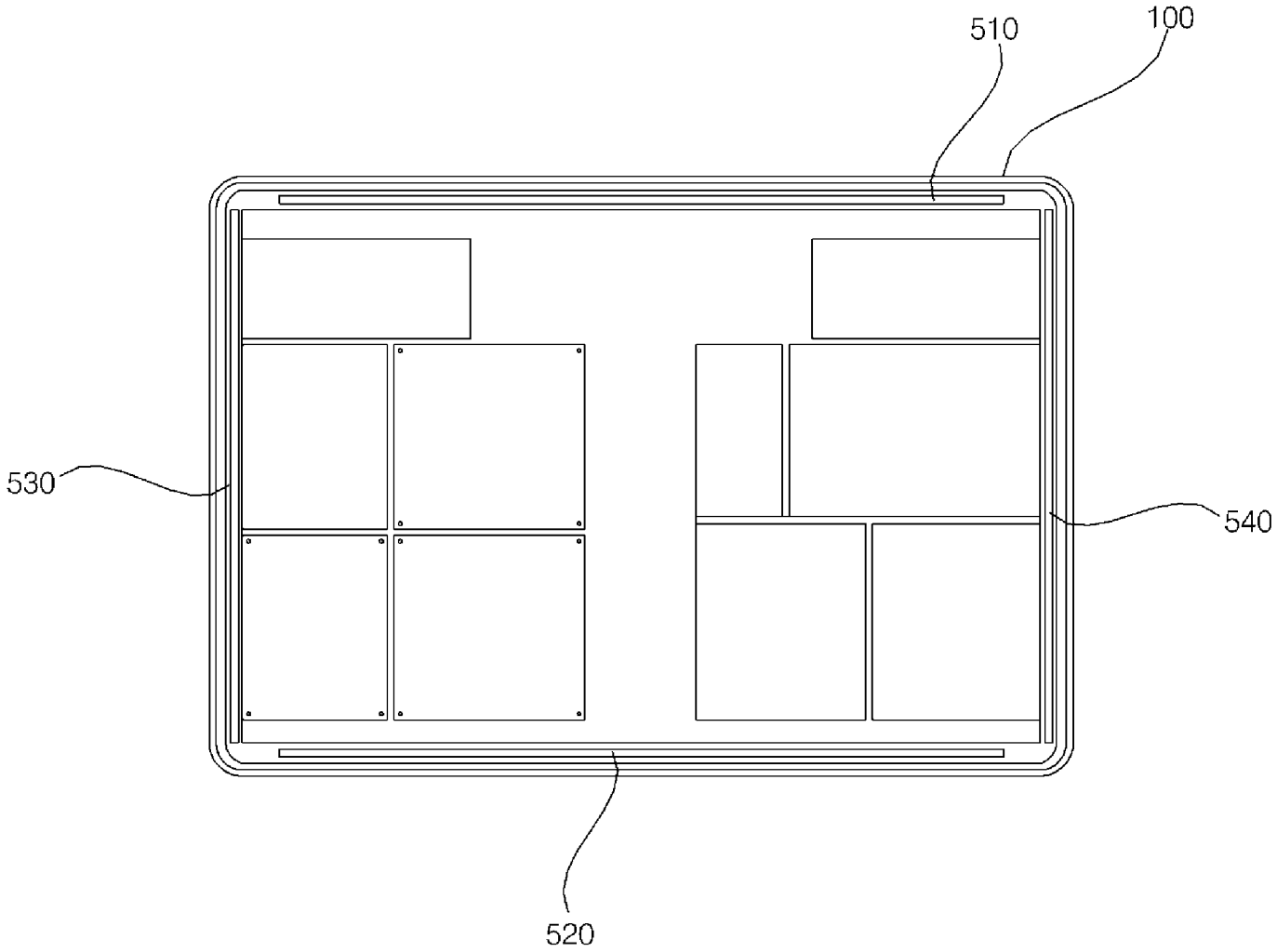
FIG. 5 is a view of lighting equipment installed on the bathroom management apparatus according to the first exemplary embodiment of the present disclosure.
Figure 6:
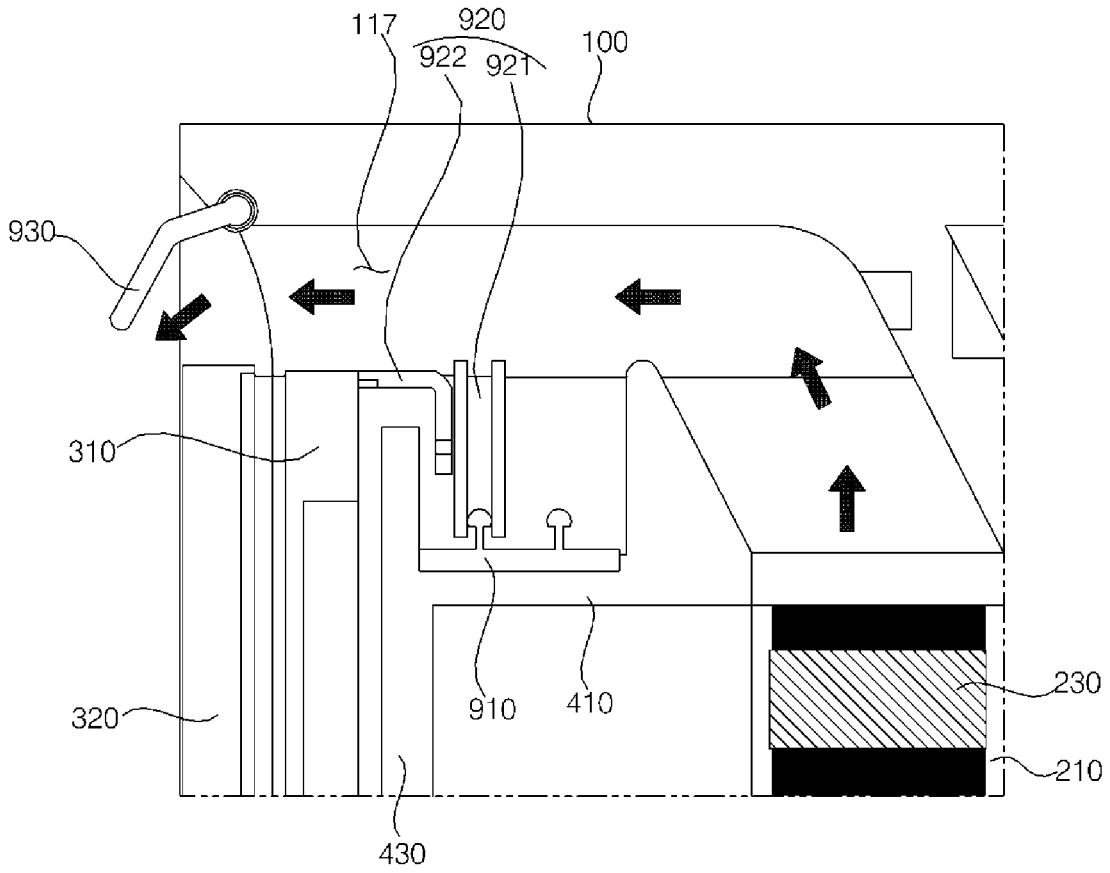
FIG. 6 is a view of an outlet vane when opened in first open mode, in the bathroom management apparatus according to the first exemplary embodiment of the present disclosure.
Figure 7:
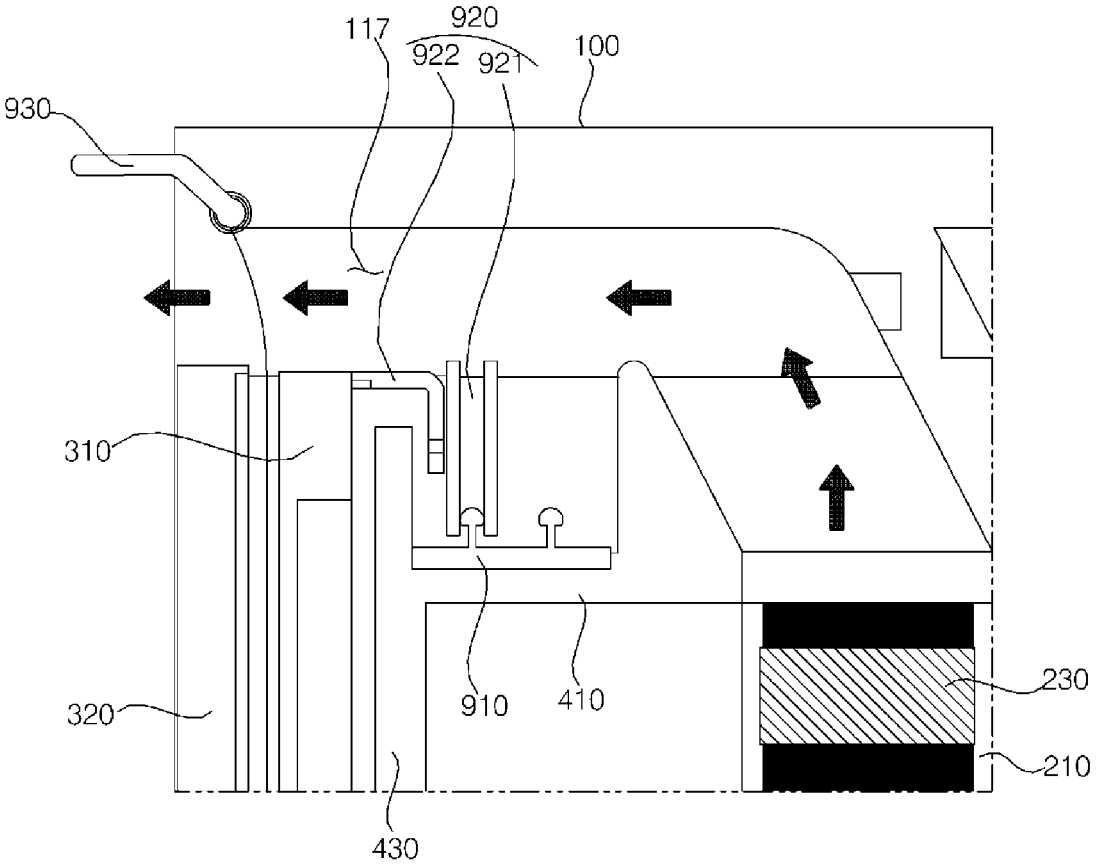
FIG. 7 is a view of the outlet vane when opened in second open mode, in the bathroom management apparatus according to the first exemplary embodiment of the present disclosure.
Figure 8:
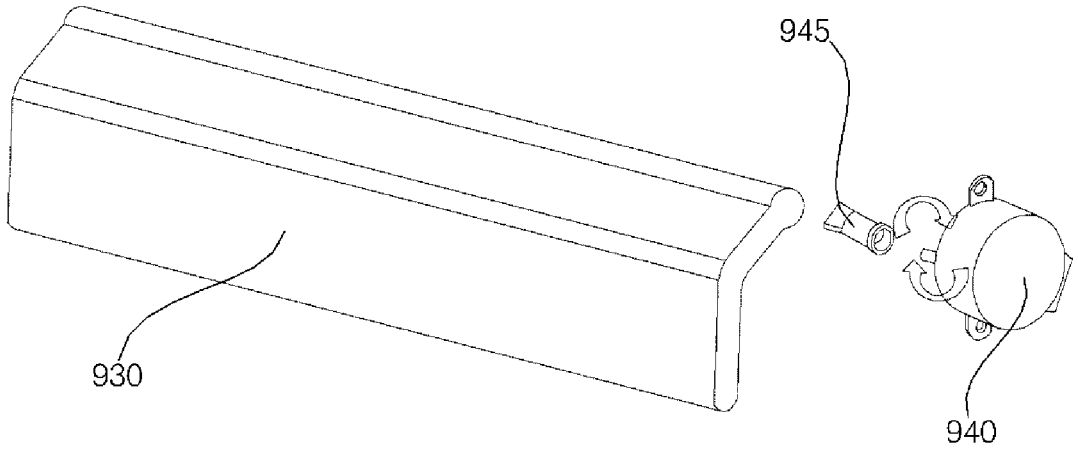
FIG. 8 is a perspective view of the outlet vane and an outlet vane motor in the bathroom management apparatus according to the first exemplary embodiment of the present disclosure.
Figure 9:
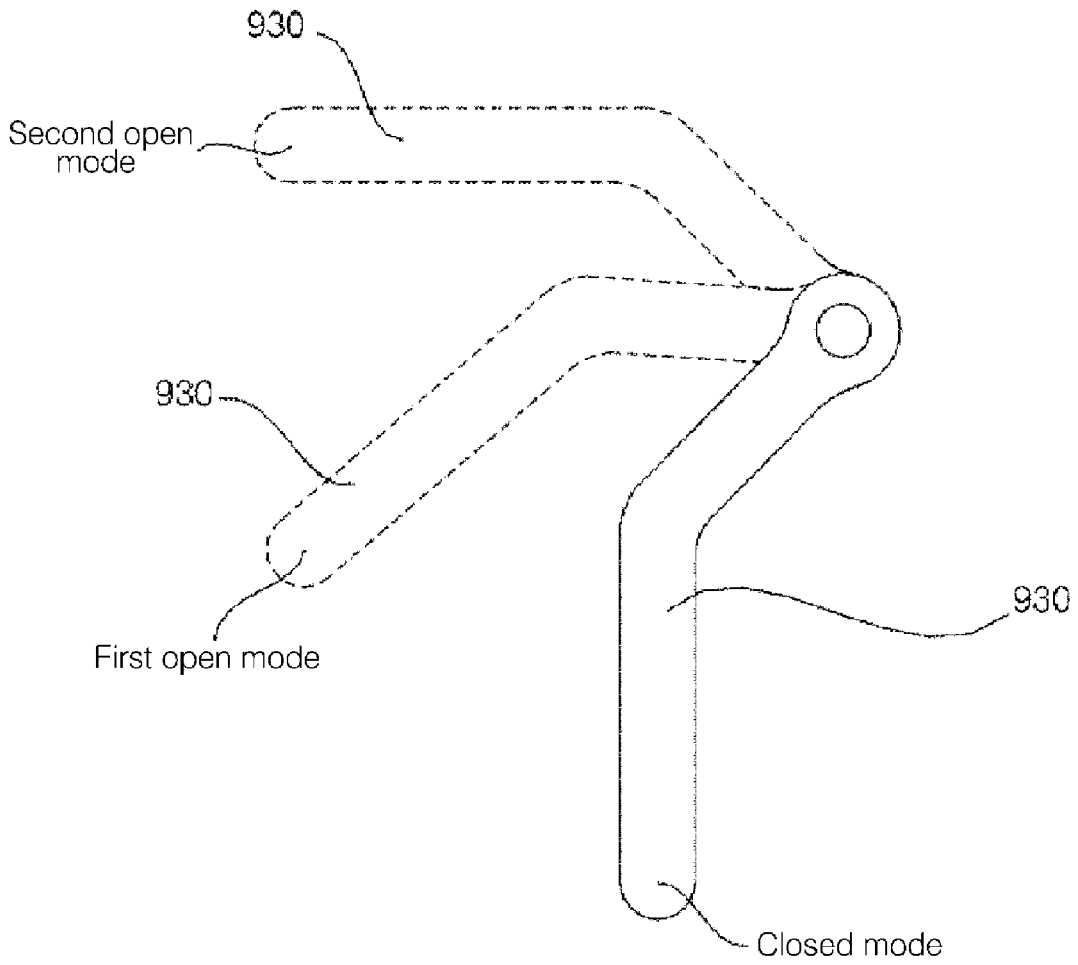
FIG. 9 is a view of the outlet vane's different positions for different modes, in the bathroom management apparatus according to the first exemplary embodiment of the present disclosure.
Figure 10:
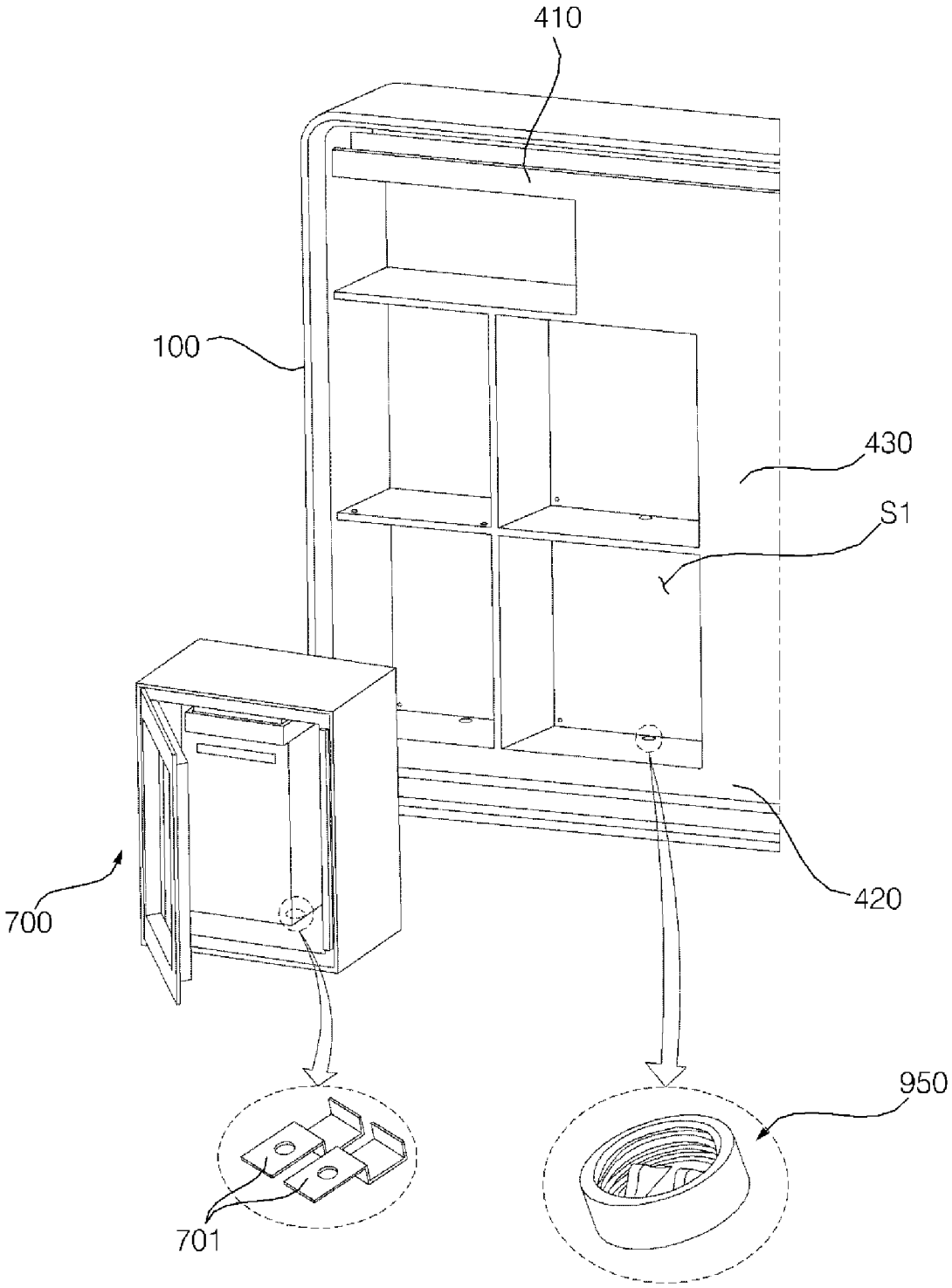
FIG. 10 is a view of a power contact unit that feeds power to a module installed on the bathroom management apparatus according to the first exemplary embodiment of the present disclosure.
Figure 11:
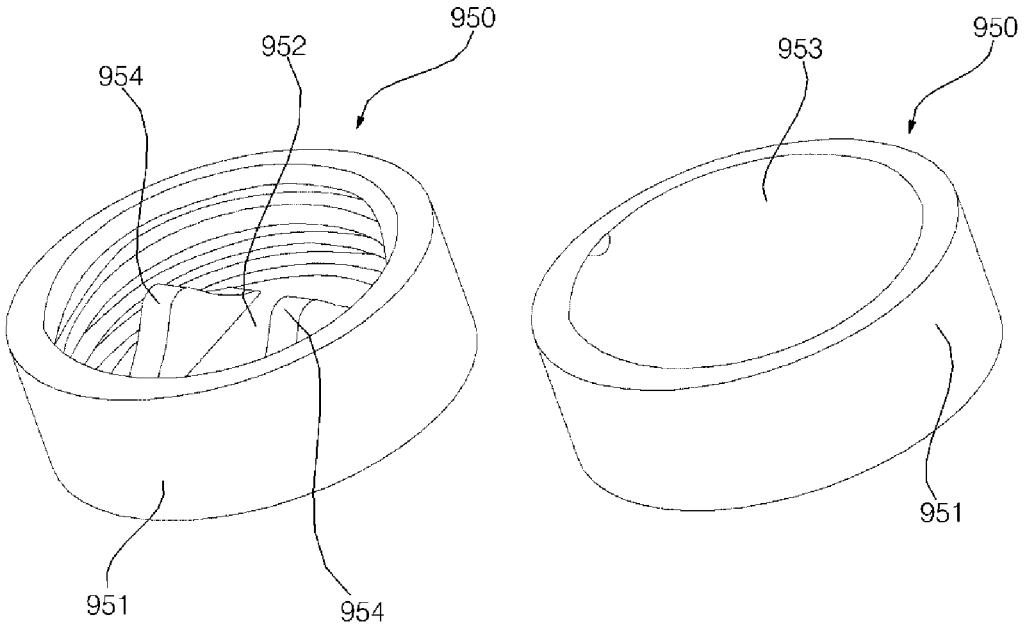
FIG. 11 is a view of a cover attached to the power contact unit when there is no module installed on the bathroom management apparatus according to the first exemplary embodiment of the present disclosure.
Figure 12:
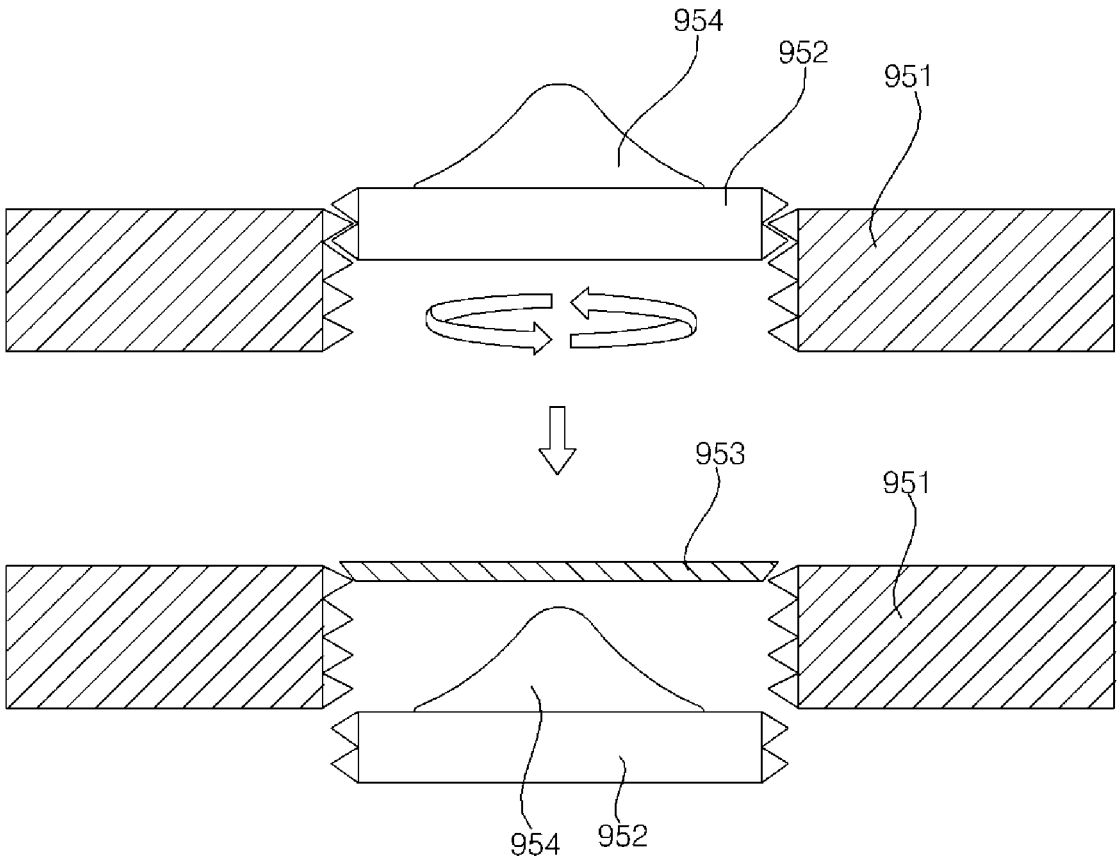
FIG. 12 is a view of how the position of the power contact unit differs depending on whether or not there is a module installed on the bathroom management apparatus according to the first exemplary embodiment of the present disclosure.
Figure 13:
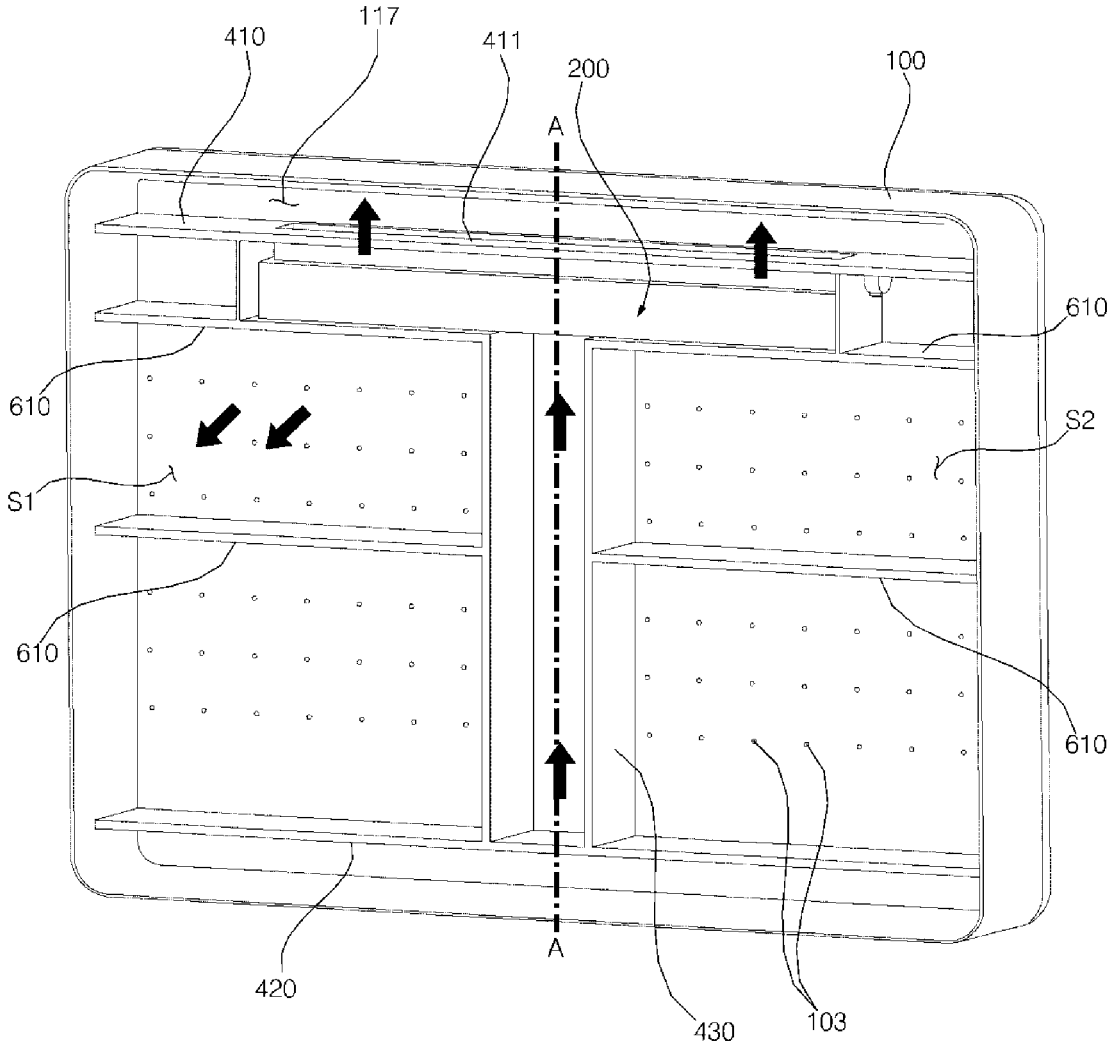
FIG. 13 is a view of a cabinet for a bathroom management apparatus according to a second exemplary embodiment of the present disclosure.
Figure 14:
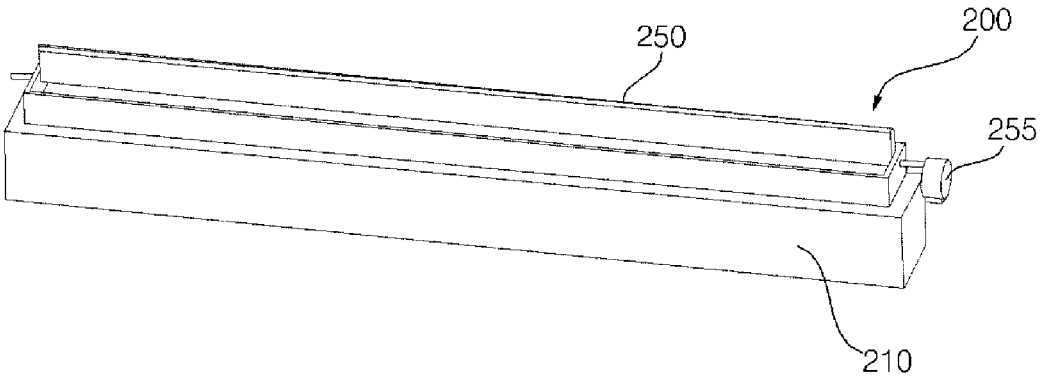
FIG. 14 is a view of the air conditioning unit of FIG. 13.

FIG. 5 is a view of lighting equipment installed on the bathroom management apparatus according to the first exemplary embodiment of the present disclosure. Referring to FIGS. 2 and 5, the lighting equipment 510, 520, 530, and 540 may be installed on at least one side within the cabinet 100. The lighting equipment 510, 520, 530, and 540 generates light and illuminates the bathroom through the gaps between the cabinet 100 and the door 300. The light generated by the lighting equipment 510, 520, 530, and 540 may illuminate the bathroom through the gaps between the cabinet 100 and the door 300. In one example, the lighting equipment 510, 520, 530, may provide relatively dimly illumination through the gaps. The lighting equipment 510, 520, 530, and 540 may include a light source for generating light and a case in which the light source may be installed. For example, the light source may be implemented as a light-emitting diode (LED).

The lighting equipment 510, 520, 530, and 540 may include a first lighting device 510 installed on the inside of the top portion of the cabinet 100, a second lighting device 520 installed on the inside of the bottom portion of the cabinet 100, a third lighting device 530 installed on the inside of the left portion of the cabinet 100, and a fourth lighting device 540 installed on the inside of the right portion of the cabinet 100.

The first lighting device 510 may illuminate the bathroom through the gap between the top portion of the cabinet 100 and the top of the door 300, the second lighting device 520 may illuminate the bathroom through the gap between the bottom portion of the cabinet 100 and the bottom of the door 300. Similarly, the third lighting device 530 may illuminate the bathroom through the gap between the left portion of the cabinet 100 and the left of the door 300, and the fourth lighting device 540 may illuminate the bathroom through the gap between the right portion of the cabinet 100 and the right of the door 300.

Referring to FIGS. 2, 4, and 6 to 9, guide rails 910 may be installed on a top surface of the first dividing plate 410 and on a bottom surface of the second dividing plate 420, and guide units 920 may be installed on the door 300 to slide laterally along the guide rails 910 when the door 300 opens and closes and to guide the opening and closing of the door 300. Each guide unit 920 may include a roller 921 that rolls along the guide rail 910 when the door 300 opens and closes, and a support unit (or frame) 922 that is attached to the roller 921 and the backside of the door 300 and rotatably supports the roller 921.

Two guide units 920 may be installed on the top of the backside of the first door 310, and another two guide units 920 may be installed on the bottom of the backside of the first door 310. Likewise, two more guide units 920 may be installed on the top of the backside of the second door 320, and still another two guide units 920 may be installed on the bottom of the backside of the second door 320.

Meanwhile, an outlet vane (or cover) 930 for opening and closing the air outlet 117 may be installed on the cabinet 100. The outlet vane 930 may be provided between the top portion of the cabinet 100 and the top of the door 300 to open and close the air outlet 117. An outlet vane motor 940 for driving the outlet vane 930 may be installed on the cabinet 100. The outlet vane 930 may extend or run laterally, and a length of the outlet vane 930 corresponds to the length of the air outlet 117. A rotating shaft 945 of the outlet vane motor 940 may be attached to one longitudinal end of the outlet vane 930 and rotate the outlet vane 930.

The outlet vane 930 may be shaped like it is bent once (e.g., initially extend in a first direction to an intermediate location and then extend in a different direction from the intermediate location), and its top end may be attached to the rotating shaft 945 of the outlet vane motor 940. The outlet vane 930 may open or close in one of three modes depending on the angle of rotation of the rotating shaft 945 of the outlet vane motor 940. That is, the outlet vane 930 may be in one of a closed mode for closing the air outlet 117, a first open mode for slightly opening the air outlet 117, or a second open mode for fully opening the air outlet 117.

When the blast fan 220 is not driven, the outlet vane 930 may be in the closed mode. For example, the part of the outlet vane 930 positioned in front of the air outlet 117 may be configured to slope downward towards the front when the blast fan 220 is driven, and the outlet vane 930 may open in the first open mode. Thus, when the outlet vane 930 opens in the first open mode, a flow of the air released from the air outlet 117 may hit the part of the outlet vane 930 positioned in front of the air outlet 117 and may be directed downwards in the bathroom. In this way, when the outlet vane 930 opens in the first open mode, the resulting redirected air flow may remove drops of moisture on the mirror 311 provided on the front of the door 300 and also helps dry excess water from a user's body after a shower.

When the blast fan 220 is driven and the outlet vane 930 opens in the second open mode (e.g., the fully opened mode), the air released from the air outlet 117 may be directed upwards in the bathroom. In this way, when the outlet vane 930 opens in the second open mode, it may be used to dry the bathroom.

Referring to FIGS. 2 and 10 to 12, a power contact unit 950 may be installed in a portion of cabinet 100 corresponding to where the module 700 is installed in the storage chambers S1 and S2. The power contact unit 950 may include a housing 951 and a contact plate 952 contained within the housing 951 in such a way as to be taken out of the housing 951.

The housing 951 may be formed in the shape of a relatively shallow cylinder with a hollow inside in which the contact plate 952 may be contained. Preferably, the housing 951 may be inserted into a hole formed in one side forming the storage chambers S1 and S2 of the cabinet 100 and may be provided in parallel with the one side forming the storage chambers S1 and S2 of the cabinet 100.

The contact plate 952 may be shaped like a disc, with a contact protrusion 954 formed on one side which comes into contact with a contact terminal 701 provided on the module 700. Preferably, the contact protrusion 954 may be formed on one side of the contact plate 952 in the direction in which it may be taken out of the housing 951. Since the electric power converted by the power supply 820 flows through the contact protrusion 954, the contact terminal 701 provided on the module 700 may come into contact with the contact protrusion 954 and receive electric power if the module 700 is installed in the storage chambers S1 and S2.

As previously described, one or more modules 700 may be selectively installed at the option of a user, and the module 700 may be omitted from one or more of the storage chambers S1 and S2. If the module 700 is not installed in the storage chambers S1 or S2, the contact protrusion 954 may not protrude from one side forming the storage chambers S1 and S2, in order to provide a desirable aesthetic appearance and to preserve space within the storage chambers S1 and S2 for storing towels or other bathroom items. Therefore, if the module 700 is not installed in the storage chambers S1 or S2, the contact plate 952 may be inserted into the housing 951. After the contact plate 952 is inserted into the housing 951, the open part of the housing 951 may be shielded by a cover 953. As the cover 953 shields the open part of the housing 951, the cover 953 may be provided in parallel with the one side forming the storage chambers S1 and S2.

In order to contain the contact plate 952 within the housing 951 and, if necessary, to take it out of the housing 951, teeth or other extensions may be formed on the inner periphery of the housing 951 and the outer periphery of the contact plate 952, and these teeth mesh with each other. Thus, the contact plate 952 may be taken out of the housing 951 by rotating it in one direction, or may be contained within the housing 951 by rotating it in the opposite direction.

Referring to FIGS. 13 to 16, it can be seen that the cabinet 100 for the bathroom management apparatus according to the second exemplary embodiment of the present disclosure may be different from that of the first exemplary embodiment shown in FIGS. 1-12. That is, in the foregoing first exemplary embodiment, the first storage chamber S1 and the second storage chamber S2 each may be divided into upper and lower sections by a horizontal dividing plate 610 and divided into left and right sections by a vertical dividing plate 620, whereas, in the second exemplary embodiment, the first storage chamber S1 and the second storage chamber S2 each may be only divided into upper and lower sections by the horizontal dividing plate 610. Optionally, in the second exemplary embodiment, the first storage chamber S1 and the second storage chamber S2 may be further divided into left and right sections by the vertical dividing plate 620, as in the first exemplary embodiment.

While one or more modules 700 may be installed in the storage chambers S1 and S2 in the foregoing first embodiment, the following discussion describes the module 700 as being omitted from the storage chambers S1 and S2 in this second exemplary embodiment. However, in some examples of this second exemplary embodiment, the module 700 may be installed in the storage chambers S1 and S2, similar to the manner described with respect as in the first exemplary embodiment.

In the rear portion of the cabinet 100, a slit 101 may be formed on the inside, and an inlet 102 for dehumidification communicating with the air conditioning module 200 and the slit 101 and a vent 103 for dehumidification communicating with the storage chambers S1 and S2 and the slit 101 may be formed.

The air conditioning module 200 may include a flow path switching vane 250 that switches a flow of conditioned (e.g., warmed and/or dried) air to either the air outlet 117 or the inlet 102 for dehumidification. The flow path switching vane 250 may be driven by a flow path switching vane motor 255. The flow path switching vane 250 may run laterally, and a rotating shaft of the flow path switching vane motor 255 may be attached to one longitudinal end of the flow path switching vane 250 and rotate the flow path switching vane 250.

Figure 15:
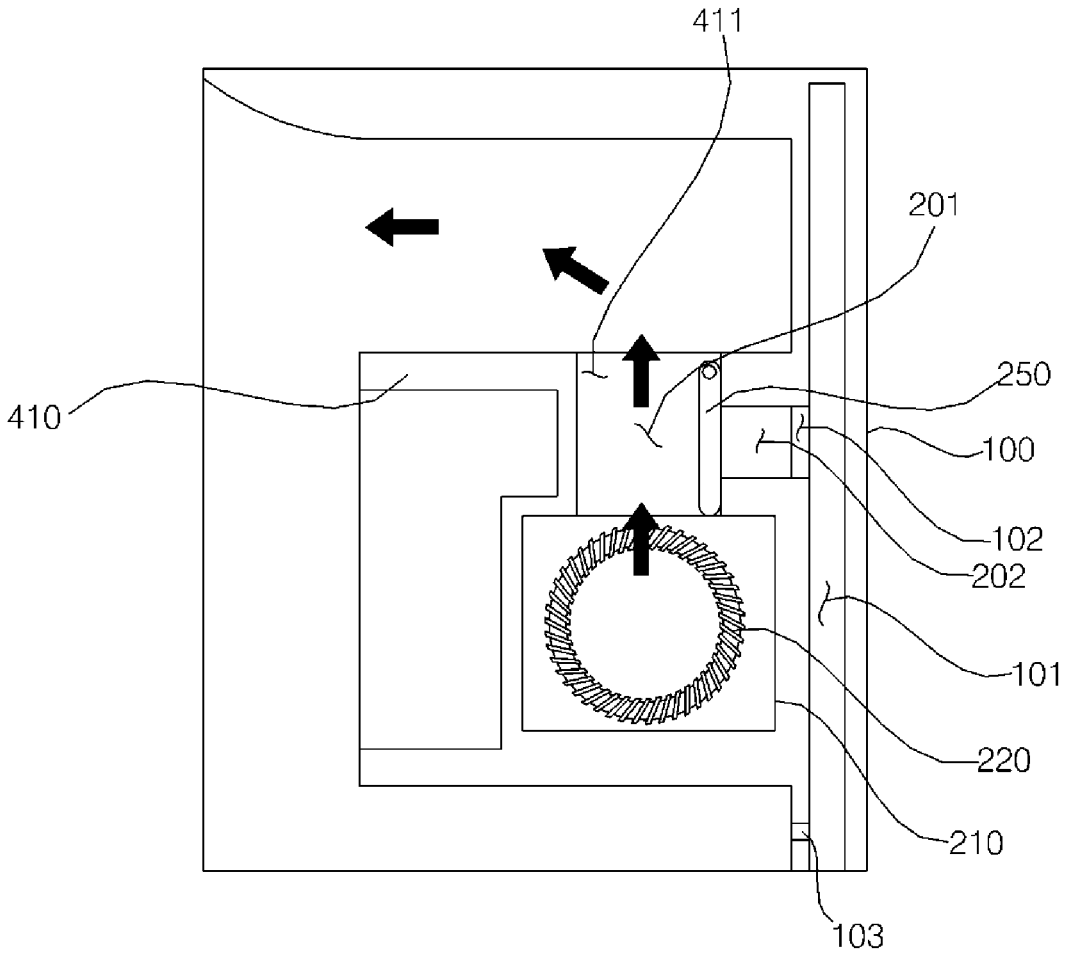
FIG. 15 is a cross-sectional view taken along the line A-A of FIG. 13, which shows that a flow path switching vane has switched the air flow in the air conditioning module to an air outlet.
Figure 16:
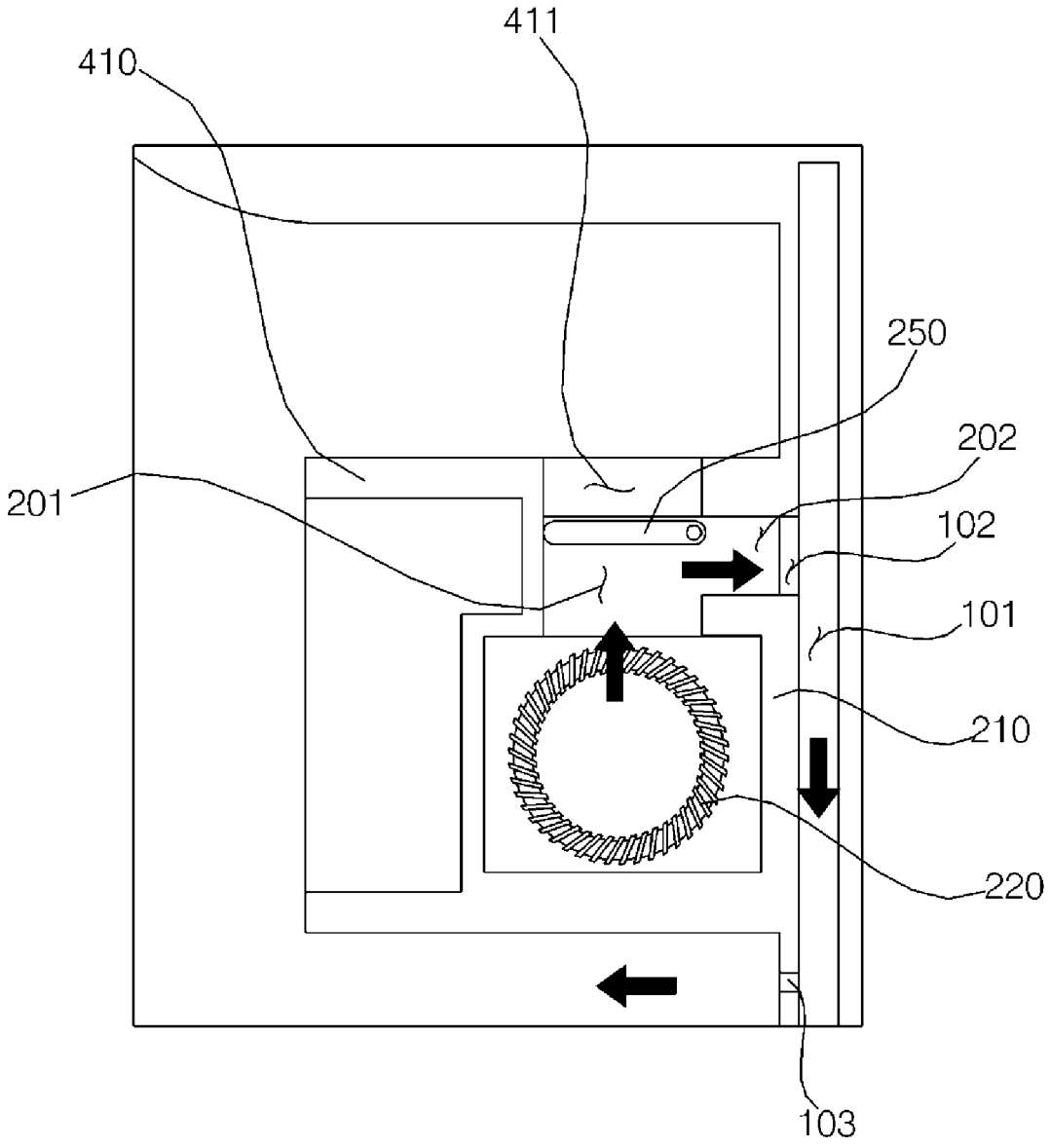
FIG. 16 is a cross-sectional view taken along the line A-A of FIG. 13, which shows that the flow path switching vane has switched the air flow in the air conditioning module to an inlet for dehumidification.

In the case 210 of the air conditioning module 200, a first flow path 201 communicating with the first communicating hole 411 may be formed in the first dividing plate 410, and a second flow path 202 communicating with the inlet 102 for dehumidification may be formed. The flow path switching vane 250 may operate in a first mode for opening the first flow path 201 and closing the second flow path 202, as shown in FIG. 15, and may operate in a second mode for closing the first flow path 201 and closing the second flow path 202, as shown in FIG. 16.

When the flow path switching vane 250 opens the first flow path 201 and closes the second flow path 202, the air in the duct 430 may pass through the first flow path 201 and the first communicating hole 411 and may be then discharged into the bathroom through the air outlet 117. Also, when the flow path switching vane 250 closes the first flow path 201 and opens the second flow path 202, the air in the duct 430 may pass through the second flow path 202 and the inlet 102 for dehumidification (e.g., by being heated) and may then flow into the storage chambers S1 and/or S2 through the vent 103 to remove moisture from the storage chambers S1 and S2.

Meanwhile, the slit 101, the inlet 102 for dehumidification, and the vent 103 for dehumidification according to the second exemplary embodiment may be formed in the rear portion of the cabinet 100 of the first exemplary embodiment, and the flow path switching vane 250 according to the second exemplary embodiment of the present disclosure may be included in the air conditioning module 200 of the first exemplary embodiment.

Meanwhile, since a bathroom management apparatus according to an exemplary embodiment of the present disclosure may be installed in a bathroom, which may be a very humid place, there may be a likelihood that moisture may enter the storage chambers S1 and/or S2, and if moisture enters the storage chambers S1 and/or S2, items stored in the storage chambers S1 and S2, such as towels, may be become damp and become contaminated with mold and/or bacteria. Thus, a technology that can keep moisture from getting into the storage chamber S1 and S2 is desirable. The following discussion provides a description of the technology that can keep moisture from entering the storage chambers S1 and S2.

Figure 17:
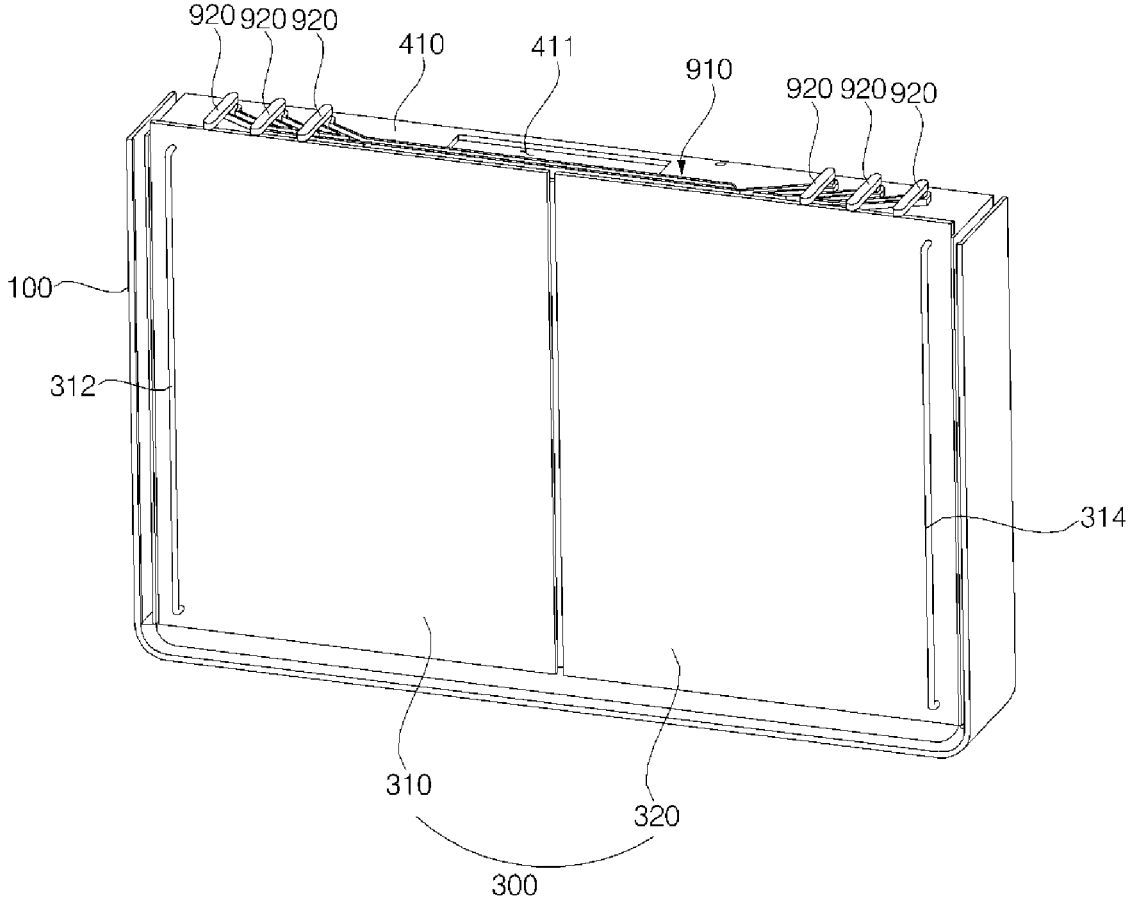
FIG. 17 is a cutaway view of the top portion of a cabinet for a bathroom management apparatus according to an exemplary embodiment of the present disclosure.

FIG. 17 is a cutaway view of the top portion of a cabinet for a bathroom management apparatus according to an exemplary embodiment of the present disclosure. Referring to FIG. 17, a guide rail 910 may be installed on the top side of the first dividing plate 410, and guide units (or guide inserts) 920 may be installed on the backside of the top edge of the door 300 to slide along the guide rail 910 when the door 300 opens and closes. Meanwhile, although not shown in FIG. 17, another guide rail 910 having a substantially same structure as the guide rail 910 installed on the top side of the first dividing plate 410 may be installed on the bottom side of the second dividing plate 420, and guide units 920 having a substantially same structure as the guide units 920 installed on the backside of the top edge of the door 300 may be installed on the backside of the bottom edge of the door 300. In one example, three guide units 920 may be installed on the backside of the top edge of the first door 310, another three guide units 920 may be installed on the backside of the bottom edge of the first door 310, additional three guide units 920 may be installed on the backside of the top edge of the second door 320, and still another three guide units 920 may be installed on the backside of the bottom edge of the second door 320.

A first knob 312 may protrude forward in the left portion of the front side of the first door 310 to be held by the user in order to open or close the first door 310, and the first knob 312 may run lengthwise. A second knob 314 may protrude forward in the right portion of the front side of the second door 320 to be held by the user in order to open or close the second door 320, and the second knob 314 may run lengthwise.

Figure 18:
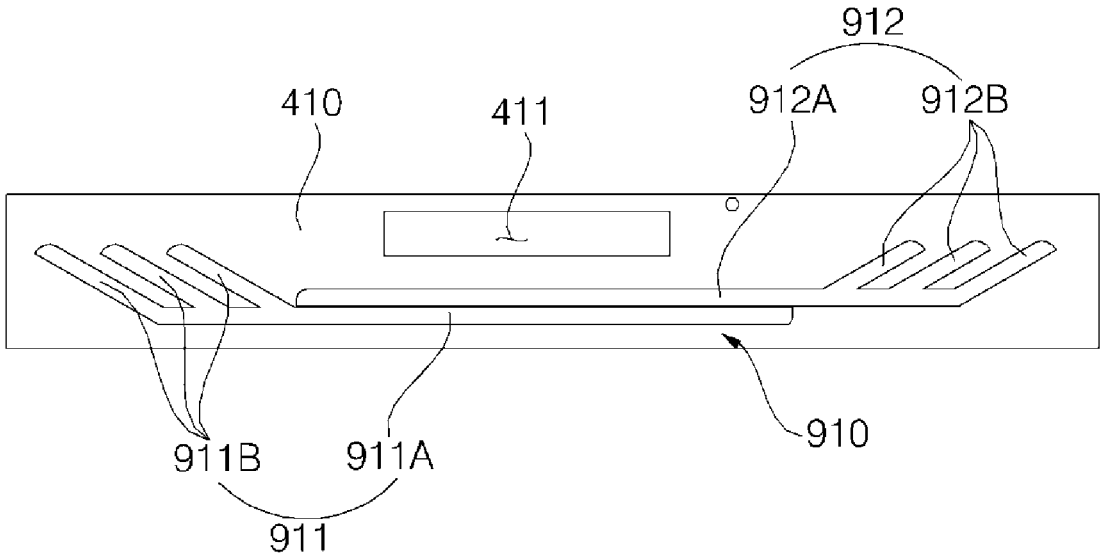
FIG. 18 is a view of the guide rail shown in FIG. 17.

FIG. 18 is a view of the guide rail shown in FIG. 17. The guide rail 910 may include a first guide rail 911 for guiding the opening and closing of the first door 310 and a second guide rail 912 for guiding the opening and closing of the second door 320. The guide rail 910 may include main rail portions 911A and 912A that run substantially straight in the lengthwise direction of the first dividing plate 410 and second dividing plate 420, and sub rail portions 911B and 912B that extend backward at an angle from one end of the main rail portions 911A and 912A.

For example, the first guide rail 911 may include a first main rail portion 911A that runs or extends substantially straight in the lengthwise direction of the first dividing plate 410 and second dividing plate 420, and a first sub rail portion 911B that extends substantially backward at an angle from one end of the first main rail portion 911A. Also, the second guide rail 912 may include a second main rail portion 912A that runs substantially straight in the lengthwise direction of the first dividing plate 410 and second dividing plate 420, and a second sub rail portion 912B that extends backward at an angle from one end of the second main rail portion 912A. The first guide rail 911 and the second guide rail 912 may be installed in such a way that the first main rail portion 911A is located ahead of the second main rail portion 912A. However, in other examples, the first guide rail 911 and the second guide rail 912 may be installed in such a way that the second main rail portion 912A may be located ahead of the first main rail portion 911A.

The first door 310 and the second door 320 may slide laterally to open and close. That is, the door 310 may close as the left end gets close to the left portion of the cabinet 100 and may open as the left end gets farther away from the left portion of the cabinet 100, and the second door 320 may close as the right end gets close to the right portion of the cabinet 100 and may open as the right end gets farther away from the right portion of the cabinet 100.

The first sub rail portion 911B may extend backward at an angle from the left end of the first main rail portion 911A so as to correspond to where the first door 310 closes. The second sub rail portion 912B may extend backward at an angle from the right end of the second main rail portion 912A so as to correspond to a location where the second door 320 closes.

The guide units 920 may slide laterally along the main rail portions 911A and 912A while the door 300 slides laterally, and the guide units 920 may move backward along the sub rail portions 911B and 912B from where the door 300 closes. Thus, when the door 300 is closed, the door 300 may seal off the storage chambers S1 and S2 so as to prevent moisture from getting into the storage chambers S1 and S2.

A plurality of sub rail portions 911B and 912B may be formed, and a substantially same number of guide units 920 as the sub rail portions 911B and 912B may be provided. In one example, three guide units 920 may be installed on the backside of the top edge of the first door 310, corresponding to the number of first sub rail portions 911B of the first guide rail 911 installed on the top of the first dividing plate 410. Similarly, three guide units 920 may be installed on the backside of the bottom edge of the first door 310 to correspond to the number of first sub rail portions 911B of the first guide rail 911 installed on the bottom of the second dividing plate 420, and three of the guide units 920 may be installed on the backside of the top edge of the second door 320 to correspond to the number of second sub rail portions 912B of the second guide rail 912 installed on the top of the first dividing plate 410. Likewise, three of the guide units 920 may be installed on the backside of the bottom edge of the second door 320 to correspond to the number of second sub rail portions 912B of the second guide rail 912 installed on the bottom of the second dividing plate 420.

Figure 19:
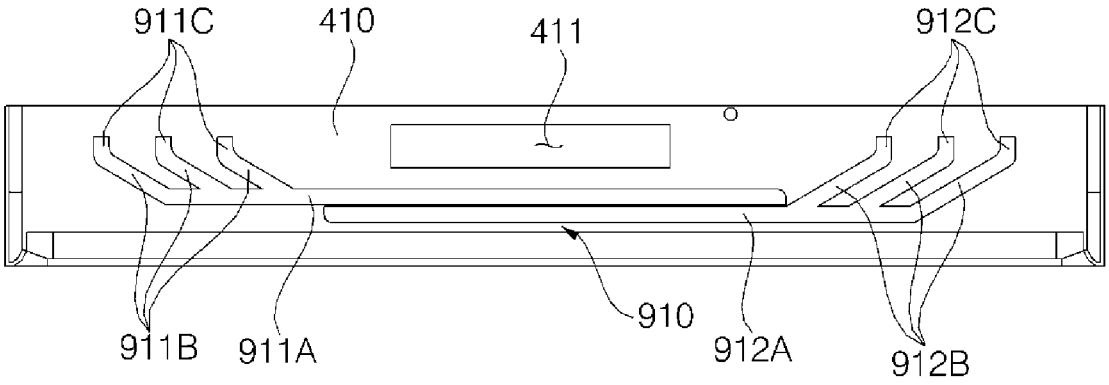
FIG. 19 is a view of another example of the guide rail shown in FIG. 18.

FIG. 19 is a view of another example of the guide rail shown in FIG. 18. Referring to FIG. 19, a guide rail 910 in another embodiment may be different from the guide rail 910 shown in FIG. 18. That is, the guide rail 910 shown in FIG. 19 further may include extensions 911C and 912C that extend straight backward from an end of the sub rail portions 911B and 912B. The extensions 911C and 912C may include a first extension 911C that may extend substantially straight backward from an end of the first sub rail portion 911B of the first guide rail 911, and a second extension 912*c* that may extend substantially straight backward from an end of the second sub rail portion 912B of the second guide rail 912. In this embodiment in which the guide rail 910 further includes extensions 911C and 912C, in comparison with the alternative guide rail 910 shown in FIG. 18, the door 300 may be moved relatively further backward when the door 300 is closed, thereby sealing off the storage chambers S1 and S2 more firmly.

Figure 20:
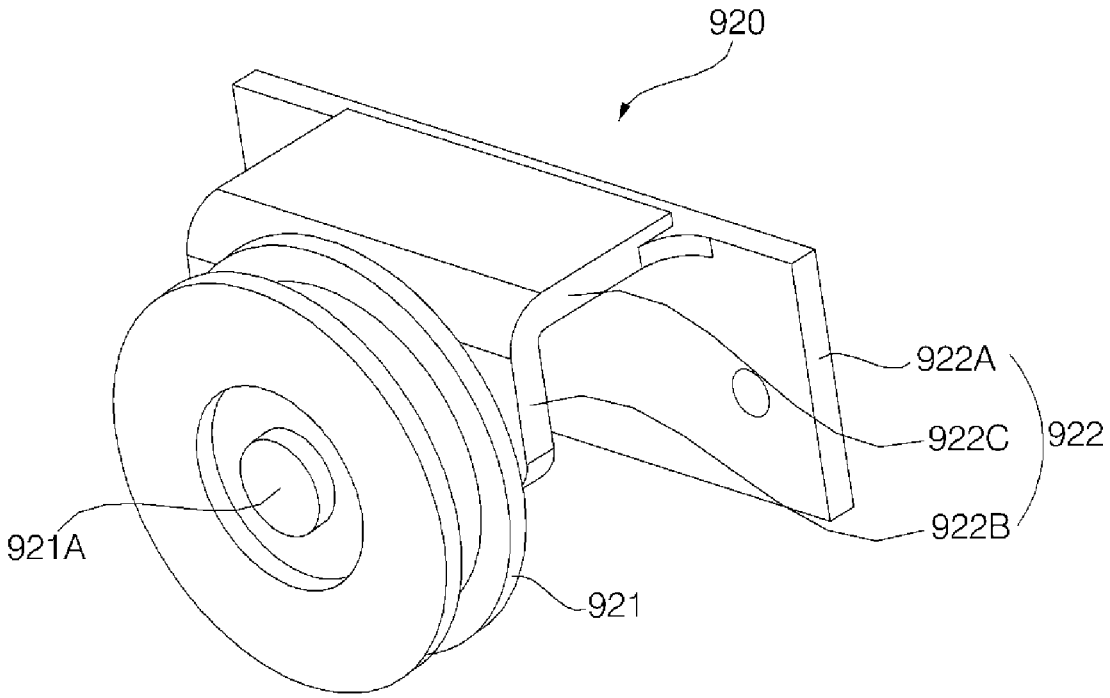
FIG. 20 is a view of each guide unit shown in FIG. 17.

FIG. 20 is a view of each guide unit shown in FIG. 17. Referring to FIG. 20, the guide unit 920 may further include a roller 921 that rolls along the guide rail 910 when the door 300 opens and closes, and a support unit 922 that may be attached to the door 300 and the roller 921 and supports the roller 921.

The support unit 922 may include a first plate body 922A attached to the backside of the door 300, a second plate body 922B provided to face the first plate body 922A and rotatably supporting the roller 921, and a connecting portion 922C connecting the first plate body 922A and the second plate body 922B. The connecting portion 922C may be bent approximately 90 degrees backwards (e.g., between 85-95 degrees) from the top edge of the first plate body 922A, and the second connecting portion 922B may be bent approximately 90 degrees (e.g., between 85-95 degrees) downwards from the connecting portion 922C. Preferably, the roller 921 may be provided on the second plate body 922B to rotate only in a circumferential direction or both in circumferential and axial directions. A slit (not shown), which may be long in a lateral direction in which the door 300 opens and closes, may be formed on the second plate body 922B, and a rotating shaft 921A of the roller 921 may be installed on the second plate body 922B so as to pass through the slit and move in the lengthwise direction of the slit, thereby causing the roller 921 to rotate in an axial direction.

Figure 21:
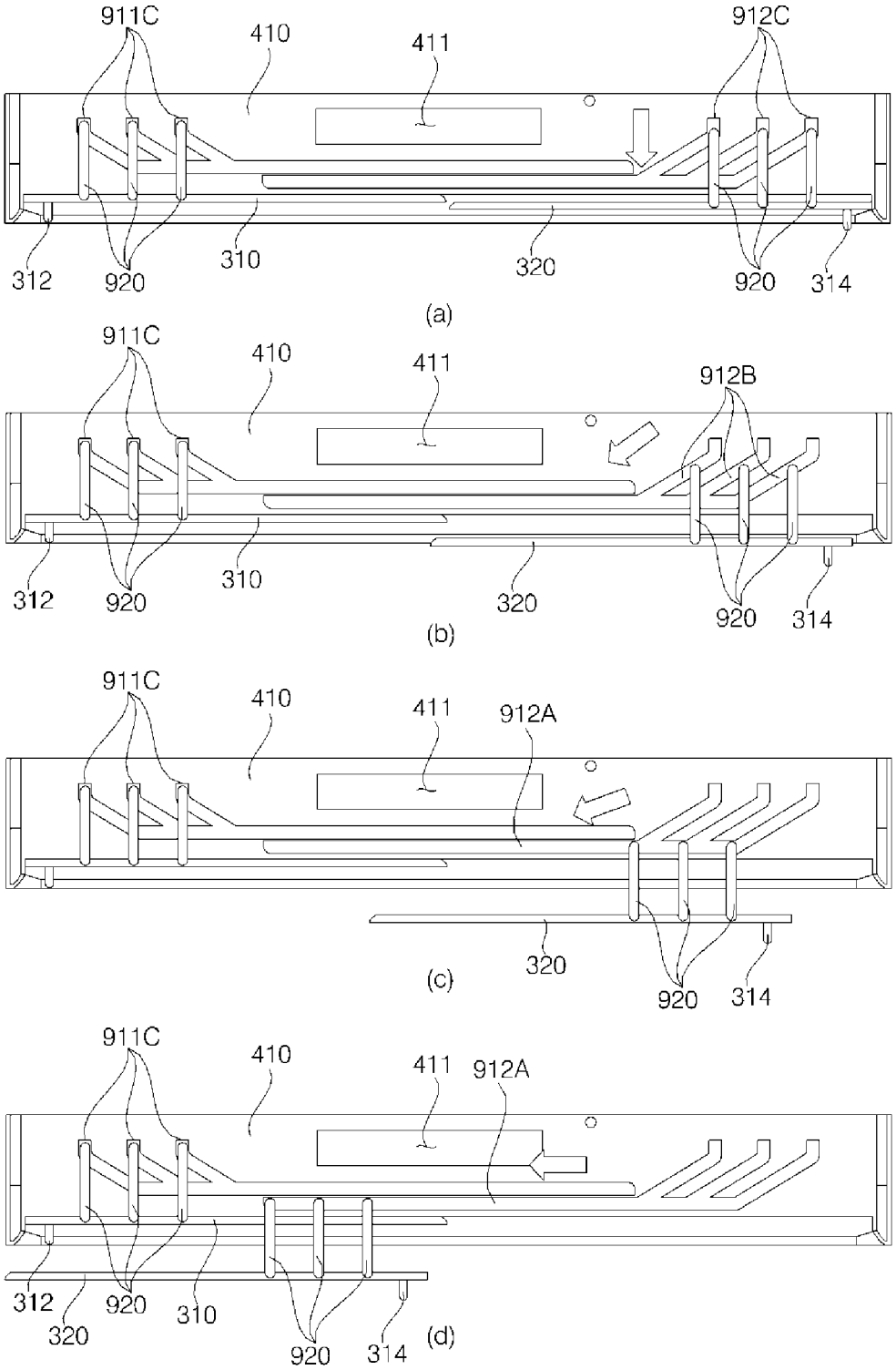
FIG. 21 is a view of a process in which one of the first and second doors opens.

FIG. 21 is a view of a process in which one of the first and second doors opens. Referring to FIG. 21, section (a) depicts that both the first door 310 and the second door 320 may be closed. In this state, the roller 921 of the guide unit 920 installed on the first door 310 may be positioned at the first extension 911C, and the roller 921 of the guide unit 920 installed on the second door 320 may be positioned at the second extension 912C.

Afterwards, referring to section (b) of FIG. 21, when the user holds the second knob 314 and pushes the second door 320 to the left in order to open the second door 320, the roller 921 of the guide unit 920 installed on the second door 320 may be positioned at the second sub rail portion 912B, and the second door 320 may protrude forward. Referring to section (c) of FIG. 21, when the user pushes the second door 320 further to the left, the roller 921 of the guide unit 920 installed on the second door 320 may be positioned at the second main rail portion 912A, and the second door 320 may protrude further forward.

Afterwards, referring to section (d) of FIG. 21, when the user pushes the second door 320 even further to the left, the roller 921 of the guide unit 920 installed on the second door 320 may roll to the left along the second main rail portion 912A, and the second door 320 may open. Meanwhile, the second door 320 closes in the order of the states shown, respectively, in sections (c), (b), and (a) of FIG. 21.

Figure 22:
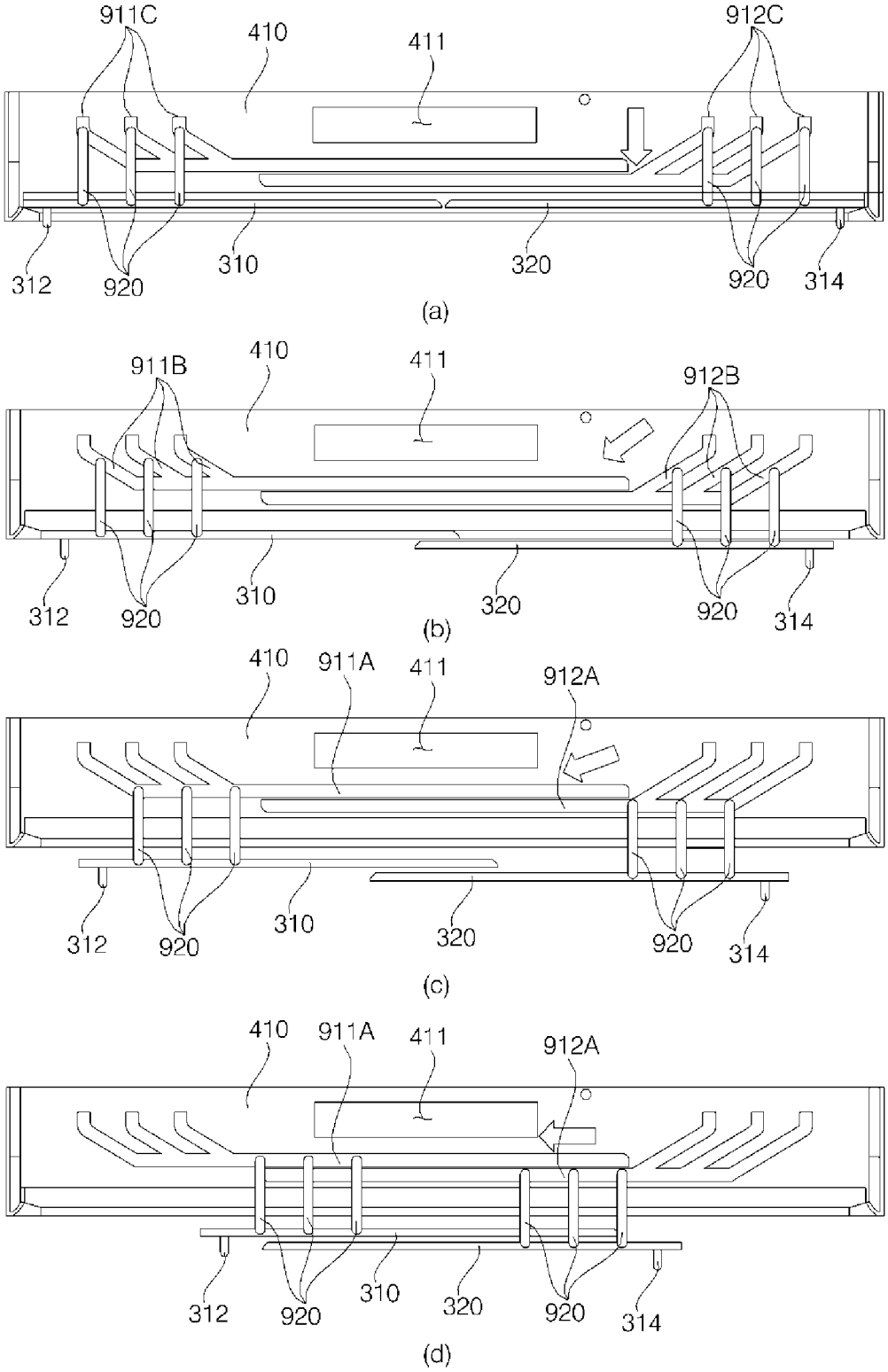
FIG. 22 is a view of a process in which the first door and the second door open simultaneously.

FIG. 22 is a view of a process in which the first door and the second door open simultaneously. Referring to FIG. 22, section (a) depicts that both the first door 310 and the second door 320 may be closed. In this state, the roller 921 of the guide unit 920 installed on the first door 310 may be positioned at the first extension 911C, and the roller 921 of the guide unit 920 installed on the second door 320 may be positioned at the second extension 912C.

Afterwards, referring to section (b) of FIG. 22, when the user holds the first knob 312 and the second knob 314 and pushes the first door 310 to the right and the second door 320 to the left to open the first door 310 and the second door 320, the roller 921 of the guide unit 920 installed on the first door 310 may be positioned at the first sub rail portion 911B. Furthermore, the roller 921 of the guide unit 920 installed on the second door 320 may be positioned at the second sub rail portion 912B, and the first door 310 and the second door 320 may protrude forward.

Afterwards, referring to section (c) of FIG. 22, when the user pushes the first door 310 further to the right and the second door 320 further to the left, the roller 921 of the guide unit 920 installed on the first door 310 may be positioned at the first main rail portion 911A, the roller 921 of the guide unit 920 installed on the second door 320 may be positioned at the second main rail portion 912A, and the first door 310 and the second door 320 protrude further forward.

Afterwards, referring to (d), when the user pushes the first door 310 still further to the right and the second door 320 still further to the left, the roller 921 of the guide unit 920 installed on the first door 310 rolls to the right along the first main rail portion 911A, the roller 921 of the guide unit 920 installed on the second door 320 rolls to the left along the second main rail portion 912A, and the first door 310 and the second door 320 may open. Similarly, the first door 310 and the second door 320 may be closed by being moved, respectively, through the states shown in sections (d), (c), (b), and (a) of FIG. 22.

Figure 23:
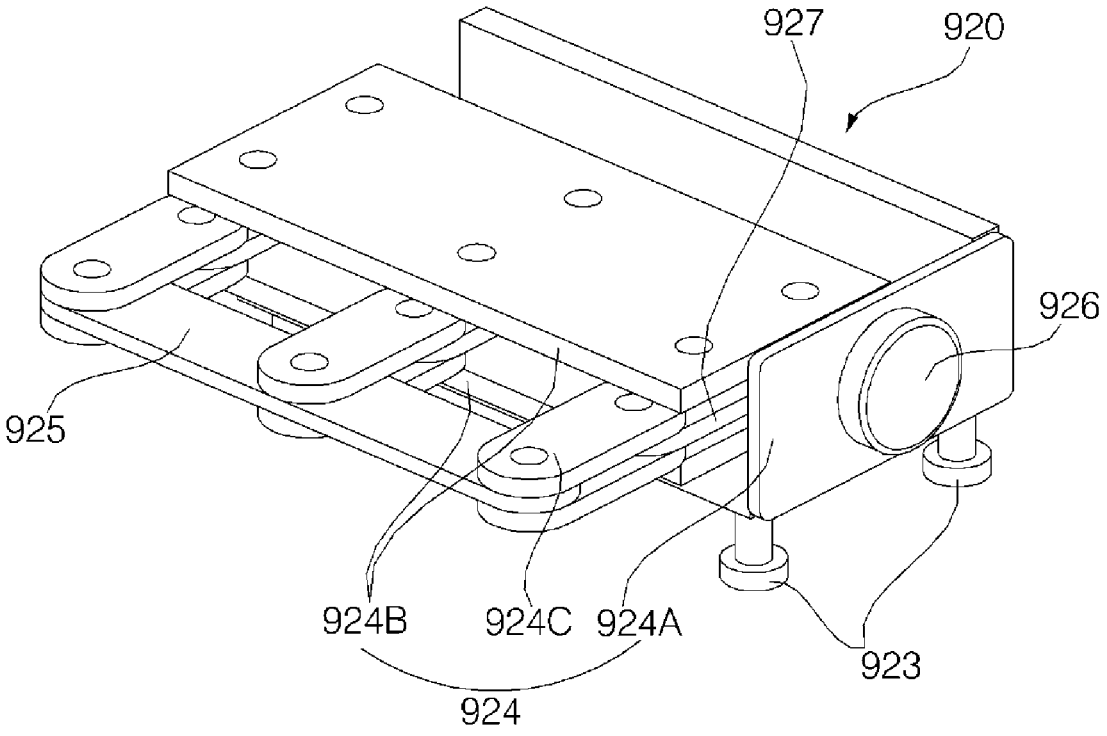
FIG. 23 is a view of another example of the guide unit shown in FIG. 20.
Figure 24:
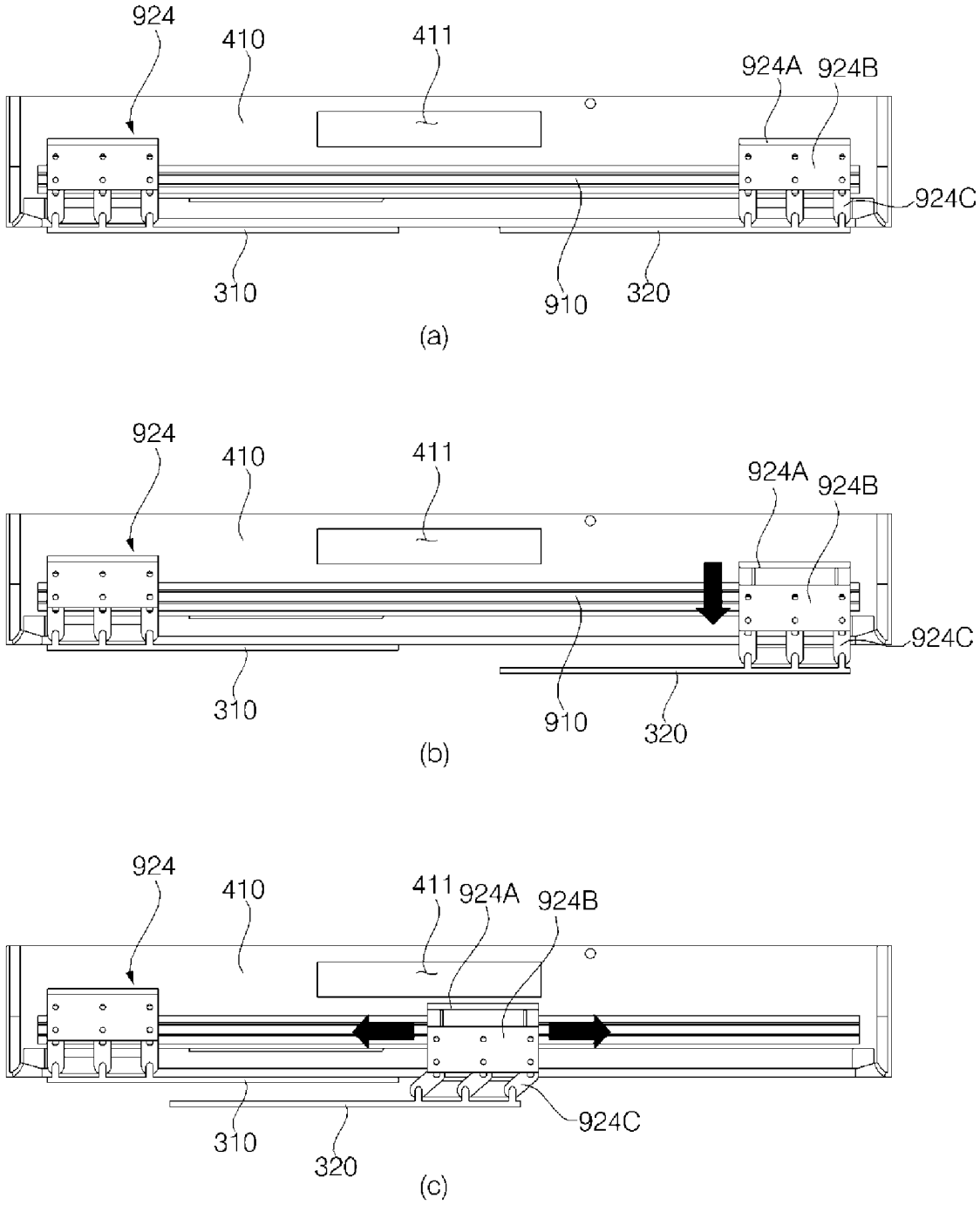
FIG. 24 is a view of a process in which one of the first and second doors opens, in a case where the guide unit shown in FIG. 23 is installed.

As previously above in the description of FIGS. 17 to 22, a guide rail 910 may include main rail portions 911A and 912A and sub rail portions 911B and 912B and may additionally include extensions 911C and 912C so that the door 300 may seal off the storage chambers S1 and S2. Referring to FIGS. 23 and 24, a guide rail 910 may run substantially straight in the lengthwise direction of the first dividing plate 410 and second dividing plate 420, and guide units 920 may be specifically configured to allow the door 300 to seal off the storage chambers S1 and S2.

FIG. 23 is a view of another example of the guide unit 920 shown in FIG. 20. Referring to FIG. 23, the guide unit 920 may include guides 923 that slide along the guide rail 910 when the door 300 opens and closes, and a support unit (or support frame) 924 that may be attached to the door 300 and the guides 923 and may support the guides 923.

The support unit 924 may include a base frame 924A supporting the guides 923, a sliding frame 924B installed on the base frame 924A to slide back and forth, and a link frame 924C, having one end that may be rotatably attached to the sliding frame 924B and the other end may be attached to the door 300. The base frame 924A may be formed into the shape of a rectangular box whose front, one side, and top may be open. The guides 923 may be round-shaped and formed on the bottom ends of supports protruding downward from the bottom of the base frame 924A.

The sliding frame 924B may be formed of a pair of plate bodies that may be vertically spaced apart and face each other. To enable the sliding frame 924B to be installed on the base frame 924A and to slide back and forth, a guide slot (not shown) may be formed on the inner side of the bottom of the base frame 924A, and a guide protrusion may be formed on the outer side of the bottom of the sliding frame 924B so as to be inserted into the guide slot and to slide back and forth.

A stationary frame 927 may be fixed between the pair of plate bodies of the sliding frame 924B. The link frame 924C may be inserted between the pair of plate bodies of the sliding frame 924B, and one end of the link frame 924C may be rotatably attached to the stationary frame 927 by a pin. The link frame 924C may include a pair of plate bodies that may be vertically spaced apart and face each other, and the stationary frame 927 may be inserted and provided between the pair of plate bodies of the link frame 924C.

The link frame 924C may be attached in such a way that its one end can rotate in the lengthwise direction of the first dividing plate 410 and second dividing plate 420, and therefore protrudes forward from the sliding frame 924B. A plurality of link frames 924C may be arranged at intervals in the lengthwise direction of the first dividing plate 410 and second dividing plate 420, and the plurality of link frames 924C may be connected together by a connecting frame 925 and rotate simultaneously in the same direction.

A motor 926 may be installed on the side of the base frame 924A. The motor 926 may drive or otherwise cause the sliding frame 924B to slide back and forth where the door 300 closes. With the motor 926 installed on the side of the base frame 924A, a pinion gear may be installed on a rotating shaft of the motor 926, and a rack gear meshing with the pinion gear may be installed on the side of the sliding frame 924B. Below, a description will be made with respect to an example in which the motor 926 is installed on the side of the base frame 924A.

FIG. 24 is a view of a process in which one of the first and second doors opens, in a case where the guide unit shown in FIG. 23 is installed. Referring to FIG. 24, section (a) depicts that both the first door 310 and the second door 320 may be closed. In this state, the sliding frame 924B of the guide unit 920 installed on the first door 310 may be in contact with the inside of the rear portion of the base frame 924A, and the sliding frame 924B of the guide unit 920 installed on the second door 320 also may be in contact with the inside of the rear portion of the base frame 924A.

Referring to section (b), when the user wants to open the second door 320, the user drives the motor 926 of the guide unit 920 installed on the second door 320 by pushing a button on the bathroom management apparatus. By doing so, the sliding frame 924B of the guide unit 920 installed on the second door 320 may slide forward as it becomes separated from the rear portion of the base frame 924A, and the second door 320 may protrude forward from the cabinet 100.

Referring to section (c), when the user pushes the second door 320 to the left, the guides 923 of the guide unit 920 installed on the second door 320 may slide along the guide rail 910 as the link frame 924C rotates to the left, and the second door 320 may open. Meanwhile, the second door 320 may be closed by going through the states depicted, respectively, in sections (c), (b), and (a) of FIG. 24.

Figure 25:
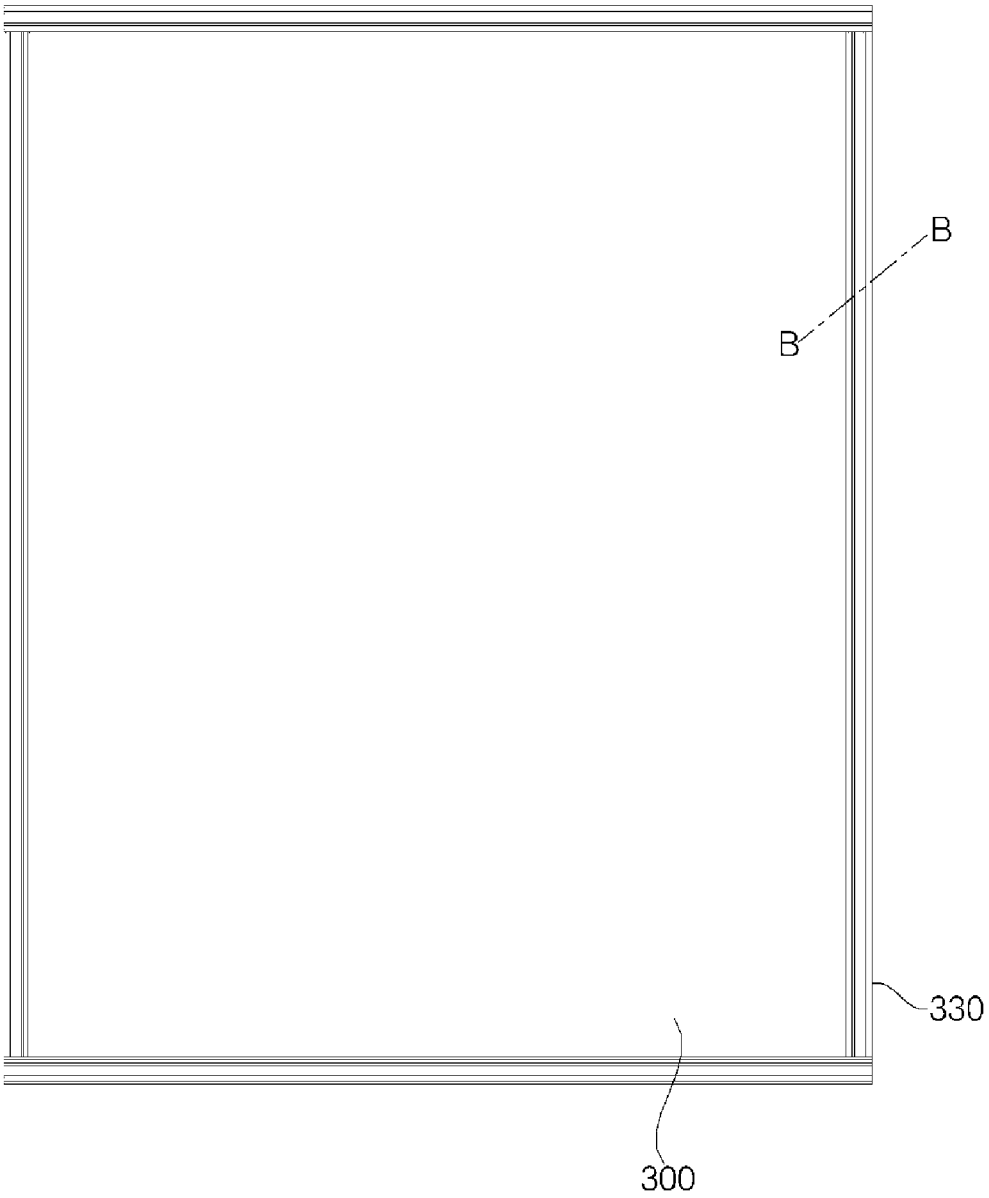
FIG. 25 is a view of the back of the door of a bathroom management apparatus according to an exemplary embodiment of the present disclosure.
Figure 26:
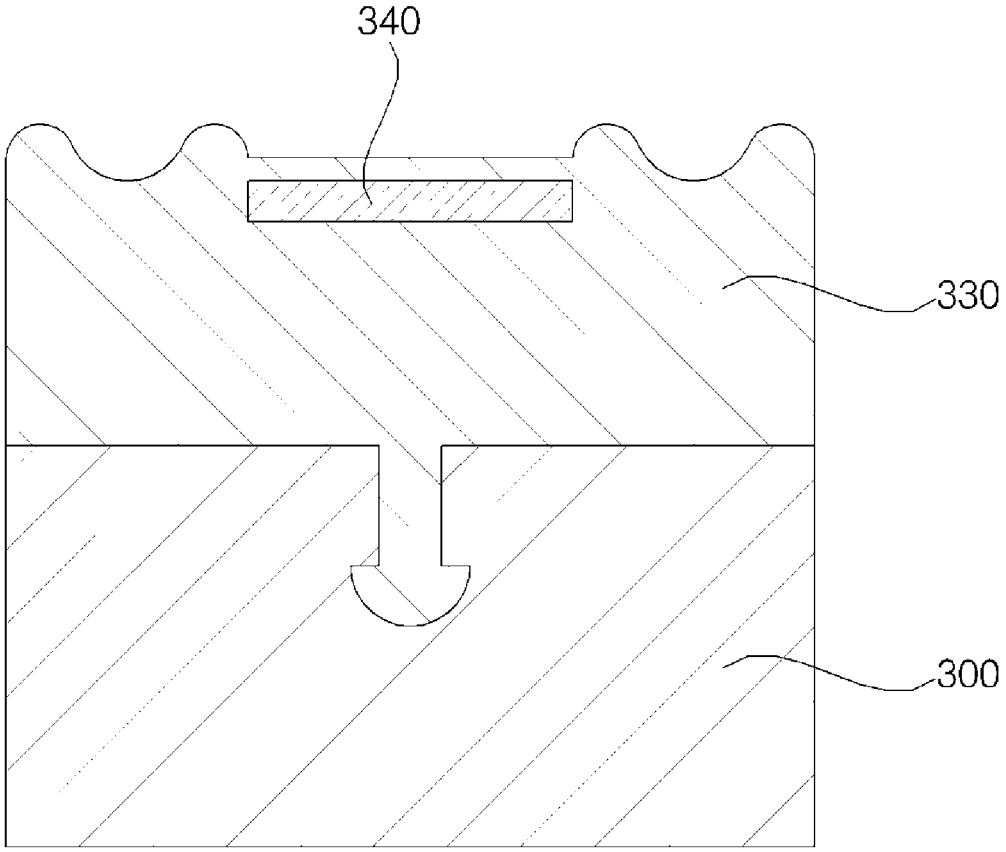
FIG. 26 is a cross-sectional view taken along the line B-B of FIG. 25.

FIG. 25 is a view of the back of the door of a bathroom management apparatus according to an exemplary embodiment of the present disclosure, and FIG. 26 is a cross-sectional view taken along the line B-B of FIG. 25. Referring to FIGS. 25 and 26, a sealing member 330 may be installed on the back edge of the door 300. When the door 300 is closed, the sealing member 320 may adhere tightly to the first dividing plate 410, the second dividing plate 420, and the left or right portion of the cabinet 100, thereby sealing off the storage chambers S1 and S2. A magnet 340 that sticks or attaches to metal may be provided on the inside of the sealing member 330 where the first dividing plate 410, second dividing plate 420, and cabinet 100 may be formed from a metallic material, such as a ferric compound, that attracts the magnetic 340. The magnet 340 may improve the sealing member 330's attachment to the first dividing plate 410, second dividing plate 420, and cabinet 100.

Accordingly, a first aspect of the present disclosure relates to a bathroom management apparatus which can minimize the likelihood of door-sliding components being seen from the outside. A second aspect of the present disclosure relates to a bathroom management apparatus which, when a door closes a storage cabinet, allows the storage cabinet to be sealed off to prevent moisture from getting into the storage cabinet.

In order to accomplish the first aspect, the present disclosure provides a bathroom management apparatus including: a cabinet forming an interior space whose front is open; a first dividing plate provided within the cabinet and dividing the interior space; a second dividing plate provided within the cabinet in parallel with the first dividing plate and dividing the interior space, and forming a storage chamber in the space between the first and second dividing plates; and a door slidably installed on the first dividing plate and second dividing plate and opening and closing the storage chamber.

In one exemplary embodiment for accomplishing the second aspect, the structure of guide rails to be described below may be specifically configured. That is, the bathroom management apparatus according to the present disclosure may further include: guide rails installed on the first dividing plate and the second dividing plate; and guide units installed on the door to slide along the guide rails when the door opens and closes, and the guide rails each may include: main rail portions that run straight in the lengthwise direction of the first dividing plate and second dividing plate; and sub rail portions that extend backward at an angle from one end of the main rail portions.

In another exemplary embodiment for accomplishing the second aspect, the structure of a support unit to be described below may be specifically configured. That is, in the bathroom management apparatus according to the present disclosure, the guide rails may run straight in the lengthwise direction of the first dividing plate and second dividing plate, and the guide units each may include: guides that slide along the guide rail when the door opens and closes; and a support unit that is attached to the door and the guides and supports the guides, and the support unit may include: a base frame supporting the guides; a sliding frame installed on the base frame to slide back and forth; and a link frame whose one end is attached to the sliding frame in such a way as to rotate in the lengthwise direction of the first dividing plate and second dividing plate and the other end is attached to the door.

When providing the first aspect of the present disclosure, components may be installed on the first dividing plate and second dividing plate to slide the door may be blocked by the cabinet, and it is possible to minimize the likelihood of the door-sliding components being seen from the outside when the door opens and closes.

According to one exemplary embodiment to provide the second aspect of the present disclosure, since the guide units slide straight along the main rail portions when the door opens and closes and move backward along the sub rail portions when the door closes completely, the door may attach tightly to the first dividing plate and the second dividing plate when the door is completely closed, thereby sealing off the storage chamber.

According to another exemplary embodiment to provide the second aspect of the present disclosure, the sliding frame slides forward when the door opens so as to cause the door to protrude forward and slides backward when the door closes so as to cause the door to move backward, and therefore the door attaches tightly to the first dividing plate and the second dividing plate, thereby sealing off the storage chamber.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A bathroom management apparatus comprising:

a cabinet including a top plate and a bottom plate and forming an interior space whose front is open;

a first dividing plate provided within the cabinet and dividing the interior space;

a second dividing plate provided within the cabinet in parallel with the first dividing plate and dividing the interior space, the first dividing plate and the second dividing plate forming a storage chamber in a space between the first and second dividing plates, wherein the first dividing plate is spaced downward from the top plate of the cabinet, and/or the second dividing plate is spaced upward from the bottom plate of the cabinet;

a dryer module provided in the cabinet to generate a flow of air;

a door slidably installed on the first dividing plate and the second dividing plate to selectively open or close the storage chamber between the first and second dividing plates;

guide rails installed on the first dividing plate and the second dividing plate; and guide inserts installed on the door to slide along the guide rails when the door opens and closes, wherein the guide rails extends in a lengthwise direction of the first dividing plate and second dividing plate, wherein each of the guide inserts includes:

guides that slide along the guide rail when the door opens and closes; and a support frame that is attached to the door and the guides, and supports the guides, and wherein the support frame includes:

a base frame to support the guides;

a sliding frame installed on the base frame to slide back and forth; and a link frame having a first end that is attached to the sliding frame to rotate in a lengthwise direction of the first dividing plate and second dividing plate, and a second end attached to the door.

2. The bathroom management apparatus of claim 1, further comprising a motor that is installed on the base frame and that drives the sliding frame to slide back and forth where the door closes.

3. The bathroom management apparatus of claim 1, further comprising a seal installed on a back edge of the door.

4. The bathroom management apparatus of claim 3, further comprising a magnet provided on an inside of the seal.

5. The bathroom management apparatus of claim 1, wherein:

the cabinet has a rectangle shape with a top surface, a bottom surface, and left and right surfaces, the first dividing plate is provided between the top surface and the second dividing plate and is connected to the left surface and the right surface to divide the interior space into first upper and lower sections, and the second dividing plate is provided between the bottom surface and the first dividing plate and is connected to the left surface and the right surface to divide the interior space into second upper and lower sections.

6. The bathroom management apparatus of claim 1, wherein the door is placed within an edge of the open front of the cabinet and is spaced a distance apart from the edge.

7. The bathroom management apparatus of claim 1, further comprising:

a duct connected to the first dividing plate and the second dividing plate, provided within the cabinet, and dividing the storage chamber into left and right sections wherein the dryer module is installed within the duct.

8. The bathroom management apparatus of claim 7, wherein the storage chamber includes a first storage chamber provided on one side of the duct and a second storage chamber provided on another side of the duct, and the door includes a first door to selectively open or close the first storage chamber and a second door to selectively open or close the second storage chamber.

9. The bathroom management apparatus of claim 7, wherein an air inlet where air is introduced into the duct is formed in the bottom plate of the cabinet, and an air outlet where air is released out of the duct is formed in a space between the top plate of the cabinet and the first dividing plate.

10. The bathroom management apparatus of claim 9, wherein a first communicating hole is formed in the first dividing plate to communicate within the air outlet and the duct, and a second communicating hole is formed in the second dividing plate to communicate within the air inlet and the duct.

11. The bathroom management apparatus of claim 9, wherein a slit, an inlet communicating with the dryer module and the slit, and a vent communicating with the storage chamber and the slit are formed in a rear surface of the cabinet.

12. The bathroom management apparatus of claim 9, wherein the dryer module includes a vane that selectively switches the flow of air to either the air outlet or the air inlet.

13. A bathroom management apparatus comprising:

a cabinet including a top plate and a bottom plate and forming an interior space whose front is open;

a first dividing plate provided within the cabinet and dividing the interior space;

a second dividing plate provided within the cabinet in parallel with the first dividing plate and dividing the interior space, the first dividing plate and the second dividing plate forming a storage chamber in a space between the first and second dividing plates, wherein the first dividing plate is spaced downward from the top plate of the cabinet, and/or the second dividing plate is spaced upward from the bottom plate of the cabinet;

a dryer module provided in the cabinet to generate a flow of air;

a door slidably installed on the first dividing plate and the second dividing plate to selectively open or close the storage chamber between the first and second dividing plates;

a duct connected to the first dividing plate and the second dividing plate, provided within the cabinet, and dividing the storage chamber into left and right sections;

wherein the dryer module is installed within the duct, wherein an air inlet where air is introduced into the duct is formed in the bottom plate of the cabinet, and an air outlet where air is released out of the duct is formed in a space between the top plate of the cabinet and the first dividing plate, and wherein a first communicating hole is formed in the first dividing plate to communicate within the air outlet and the duct, and a second communicating hole is formed in the second dividing plate to communicate within the air inlet and the duct, a shield plate that is connected to the bottom plate of the cabinet and the second dividing plate, and that is provided further forward than the aft inlet and the second communicating hole to shield a space between the bottom plate of the cabinet and the second dividing plate.

* * * * *